US010207155B2

(12) United States Patent
Shigemitsu et al.

(10) Patent No.: US 10,207,155 B2
(45) Date of Patent: Feb. 19, 2019

(54) GOLF BALL

(71) Applicant: Dunlop Sports Co., Ltd., Kobe-shi, Hyogo (JP)

(72) Inventors: Takahiro Shigemitsu, Kobe (JP); Hidetaka Inoue, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 80 days.

(21) Appl. No.: 14/754,156

(22) Filed: Jun. 29, 2015

(65) Prior Publication Data

US 2015/0375055 A1 Dec. 31, 2015

(30) Foreign Application Priority Data

| | | |
|---|---|---|
| Jun. 30, 2014 | (JP) | 2014-135404 |
| Jun. 30, 2014 | (JP) | 2014-135409 |
| May 14, 2015 | (JP) | 2015-099147 |
| May 14, 2015 | (JP) | 2015-099151 |

(51) Int. Cl.
*A63B 37/06* (2006.01)
*A63B 37/00* (2006.01)

(52) U.S. Cl.
CPC ..... *A63B 37/0076* (2013.01); *A63B 37/008* (2013.01); *A63B 37/0031* (2013.01); *A63B 37/0043* (2013.01); *A63B 37/0044* (2013.01); *A63B 37/0045* (2013.01); *A63B 37/0049* (2013.01); *A63B 37/0062* (2013.01); *A63B 37/0086* (2013.01); *A63B 37/0092* (2013.01)

(58) Field of Classification Search
CPC ..... A63B 37/0043
USPC ..... 473/376
See application file for complete search history.

(56) References Cited

U.S. PATENT DOCUMENTS

| | | | | |
|---|---|---|---|---|
| 5,772,531 | A * | 6/1998 | Ohsumi | A63B 37/0003 473/373 |
| 6,117,025 | A * | 9/2000 | Sullivan | A63B 37/0003 473/373 |
| 6,251,031 | B1 * | 6/2001 | Hayashi | A63B 37/0003 473/376 |
| 6,743,122 | B2 * | 6/2004 | Hayashi | A63B 37/0003 473/376 |
| 2002/0034987 | A1 | 3/2002 | Yamagishi et al. | |
| 2003/0013557 | A1 * | 1/2003 | Kennedy, III | A63B 37/0003 473/374 |
| 2009/0011855 | A1 | 1/2009 | Sullivan et al. | |

FOREIGN PATENT DOCUMENTS

| | | |
|---|---|---|
| JP | 8-336617 A | 12/1996 |
| JP | 2009-233335 A | 10/2009 |

* cited by examiner

*Primary Examiner* — Raeann Gorden
(74) *Attorney, Agent, or Firm* — Birch, Stewart, Kolasch & Birch, LLP

(57) ABSTRACT

An object of the present invention is to provide a golf ball showing a low spin rate on driver shots and a high spin rate on approach shots. The present invention provides a golf ball comprising a spherical center, at least two envelope layers covering the spherical center, and a cover covering the envelope layers, wherein an envelope layer (Es1) formed from a material having a lowest material hardness among a center constituent material and envelope layers constituent materials, is disposed in a region located at a distance from 36.0% to 65.0% of a golf ball radius from a center point of the golf ball.

18 Claims, 3 Drawing Sheets

GOLF BALL

FIELD OF THE INVENTION

The present invention relates to a golf ball.

DESCRIPTION OF THE RELATED ART

As a method of inhibiting the spin rate on driver shots, a method of controlling the hardness distribution of the golf ball is exemplified. For example, by adopting an outer-hard and inner-soft hardness distribution in the golf ball, the spin rate on driver shots can be lowered, thus the flight distance on driver shots can be increased.

As the golf ball having a controlled hardness distribution, for example, Japanese Patent Publication No. H08-336617 A discloses a multi-piece solid golf ball having a structure of at least four layers consisting of a core having a structure of at least two layers and two cover layers covering the core, wherein the outer cover has a hardness of 40 to 60 in Shore D hardness, and the inner cover has a hardness of 53 or less in Shore D hardness and lower than the hardness of the outer cover.

Japanese Patent Publication No. 2009-233335 A discloses a golf ball including: a unitary core having a volume, an outer surface, a geometric center, and an outermost transition part adjacent to the outer surface, the core being formed from a substantially homogenous composition; and a cover layer, wherein the outermost transition part is disposed between the core outer surface and the geometric center, the transition part has an outer portion congruent with the core outer surface and comprises the outermost 45% of the core volume or less, and both a hardness of the core outer surface and a hardness within the outermost transition part are less than a hardness of the geometric center to define a negative hardness gradient.

SUMMARY OF THE INVENTION

By adopting the outer-hard and inner-soft hardness distribution in the golf ball, the spin rate on driver shots can be lowered. However, in this case, not only the spin rate on driver shots is lowered, but also the spin rate on approach shots tends to be lowered. Therefore, although the golf ball having the outer-hard and inner-soft structure shows an improved flight distance on driver shots, its controllability on approach shots tends to be lowered.

The present invention has been achieved in view of the above problems. An object of the present invention is to provide a golf ball showing a low spin rate on driver shots and a high spin rate on approach shots.

The golf ball according to the first embodiment of the present invention comprises a spherical center, at least two envelope layers covering the spherical center, and a cover covering the envelope layers, wherein an envelope layer (Es1) formed from a material having a lowest material hardness among a center constituent material and envelope layers constituent materials is disposed in a region located at a distance from 36.0% to 65.0% of a radius of the golf ball from a center point of the golf ball. When a golf ball having a uniform hardness is hit with a driver, the region located at a distance from 36.0% to 65.0% of the radius of the golf ball from the center point of the golf ball mostly deforms. If an envelope layer having a low hardness is disposed in this region, the spin rate on driver shots can be selectively lowered. As a result, the spin rate on driver shots is lowered while the spin rate on approach shots is maintained.

The golf ball according to the second embodiment of the present invention comprises a low-elastic-modulus layer formed from a material having a tensile elastic modulus in a range from 1 MPa to 20 MPa, wherein the low-elastic-modulus layer is disposed in a region S located at a distance from 36.0% to 65.0% of a radius of the golf ball from a center point of the golf ball. When a golf ball having a uniform hardness is hit with a driver, the region located at a distance from 36.0% to 65.0% of the radius of the golf ball from the center point of the golf ball mostly deforms. The inventors of the present invention found that the spin rate on driver shots can be selectively lowered if a low-elastic-modulus layer having a low elastic modulus is disposed in this region, and ultimately achieved the present invention. According to the present invention, a golf ball that has a small ratio of a spin rate on driver shots to a spin rate on approach shots, is obtained.

DESCRIPTION OF THE PREFERRED EMBODIMENT

The golf ball according to the first embodiment of the present invention comprises a spherical center, at least two envelope layers covering the spherical center, and a cover covering the envelope layers, wherein an envelope layer (Es1) formed from a material having a lowest material hardness among a center constituent material and envelope layers constituent materials, is disposed in a region located at a distance from 36.0% to 65.0% of a radius of the golf ball from a center point of the golf ball.

(1) Structure of Golf Ball According to the First Embodiment

The golf ball according to the first embodiment of the present invention comprises a spherical center, at least two envelope layers covering the spherical center, and a cover covering the envelope layers. The envelope layers preferably comprise at least three layers and more preferably comprise at least four layers, and preferably comprise at most ten layers and more preferably comprise at most nine layers. If the envelope layers comprise at least three layers, the hardness distribution of the golf ball becomes easily controlled. On the other hand, if the number of the envelope layers is excessively large, the moldability of the envelope layers is lowered. It is noted that a paint film and a reinforcement layer (adhesive agent layer) that is provided to improve adhesion between the envelope layers are not included in the envelope layers. The paint film and the reinforcement layer (adhesive agent layer) have a different film thickness range from the envelope layers. The paint film and the reinforcement layer (adhesive agent layer) generally have a film thickness of 50 μm (0.050 mm) or less.

Figure 1:
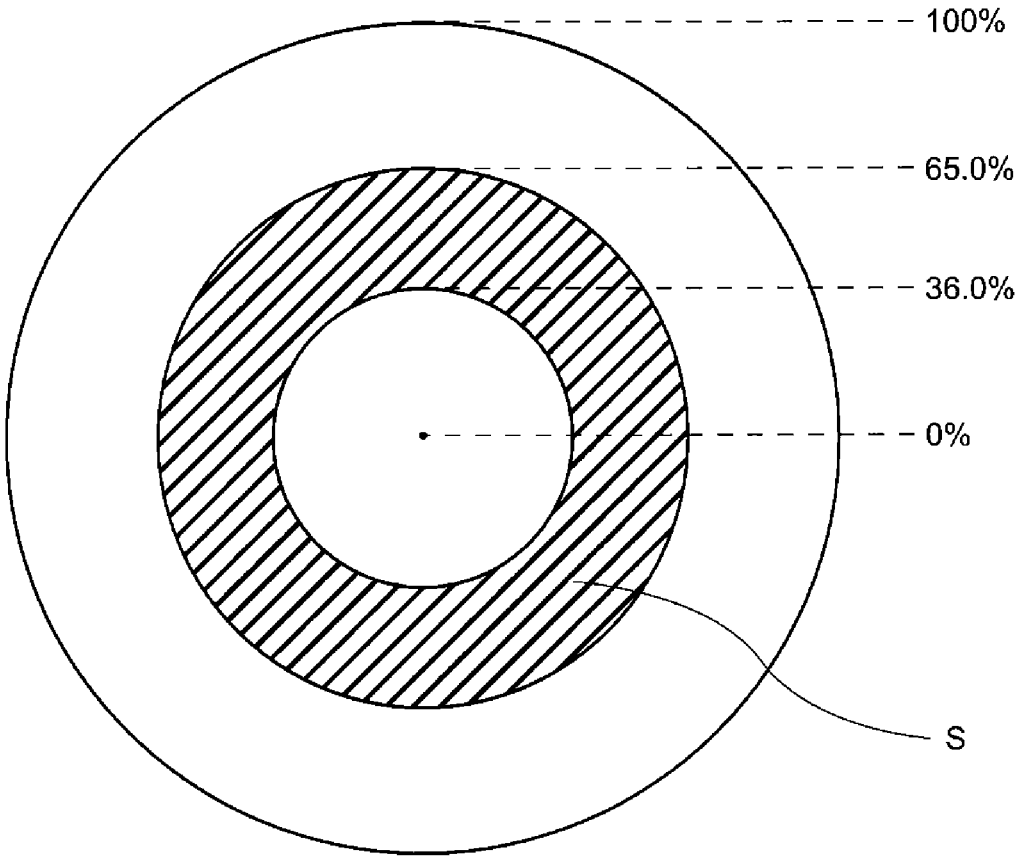
FIG. 1 is a schematic sectional view showing a region S located at a distance from 36.0% to 65.0% of a radius of the golf ball from a center point of the golf ball.

FIG. 1 is a schematic sectional view showing a region S located at a distance from 36.0% to 65.0% of a radius of the golf ball from a center point of the golf ball. In the region S of the golf ball shown in FIG. 1, an envelope layer (Es1) which is formed from a material having a lowest material hardness among a center constituent material and envelope layers constituent materials, is disposed. It is noted that the envelope layer (Es1) should be disposed as a whole within the region S. When multiple envelope layers are disposed within the region S, at least one layer of the multiple envelope layers is formed from the material having the lowest material hardness among the center constituent material and the envelope layers constituent materials.

When a golf ball having a uniform hardness is hit with a driver, the region located at a distance from 36.0% to 65.0% of the radius of the golf ball from the center point of the golf ball mostly deforms. If an envelope layer having a low hardness is disposed in this region, the spin rate on driver shots can be selectively lowered. As a result, if the hardness in this region is lowered, the spin rate on driver shots is lowered while the spin rate on approach shots is maintained. The region where the envelope layer (Es1) is disposed, is preferably located at a distance of 40.0% or more of the radius of the golf ball from the center point of the golf ball, and more preferably located at a distance of 45.0% or more of the radius of the golf ball from the center point of the golf ball, and is preferably located at a distance of 63.0% or less of the radius of the golf ball from the center point of the golf ball and more preferably located at a distance of 60.0% or more of the radius of the golf ball from the center point of the golf ball.

The thickness of the envelope layer (Es1) is preferably 0.2 mm or more, more preferably 0.5 mm or more, and even more preferably 1.0 mm or more, and is preferably 20 mm or less, more preferably 17 mm or less, and even more preferably 15 mm or less. If the thickness of the envelope layer (Es1) is 0.2 mm or more, the spin rate on driver shots is effectively lowered, and if the thickness of the envelope layer (Es1) is 20 mm or less, the resilience of the golf ball is not lowered.

The material hardness (Hs1) of the envelope layer (Es1) is preferably 2 or more, more preferably 3 or more, and even more preferably 5 or more, and is preferably 30 or less, more preferably 27 or less, and even more preferably 25 or less in Shore D hardness. If the material hardness (Hs1) is 2 or more, the resilience of the golf ball is not lowered, and if the material hardness (Hs1) is 30 or less, the spin rate on driver shots is effectively lowered. The material hardness (Hs1) of the envelope layer (Es1) is also preferably a lowest material hardness among the golf ball constituent materials.

The tensile elastic modulus of the material of the envelope layer (Es1) is preferably 1 MPa or more, more preferably 2 MPa or more, and even more preferably 3 MPa or more, and is preferably 20 MPa or less, more preferably 18 MPa or less, and even more preferably 16 MPa or less. If the tensile elastic modulus is 1 MPa or more, the resilience of the golf ball is not lowered, and if the tensile elastic modulus is 20 MPa or less, the spin rate on driver shots is easily lowered.

Figure 2:
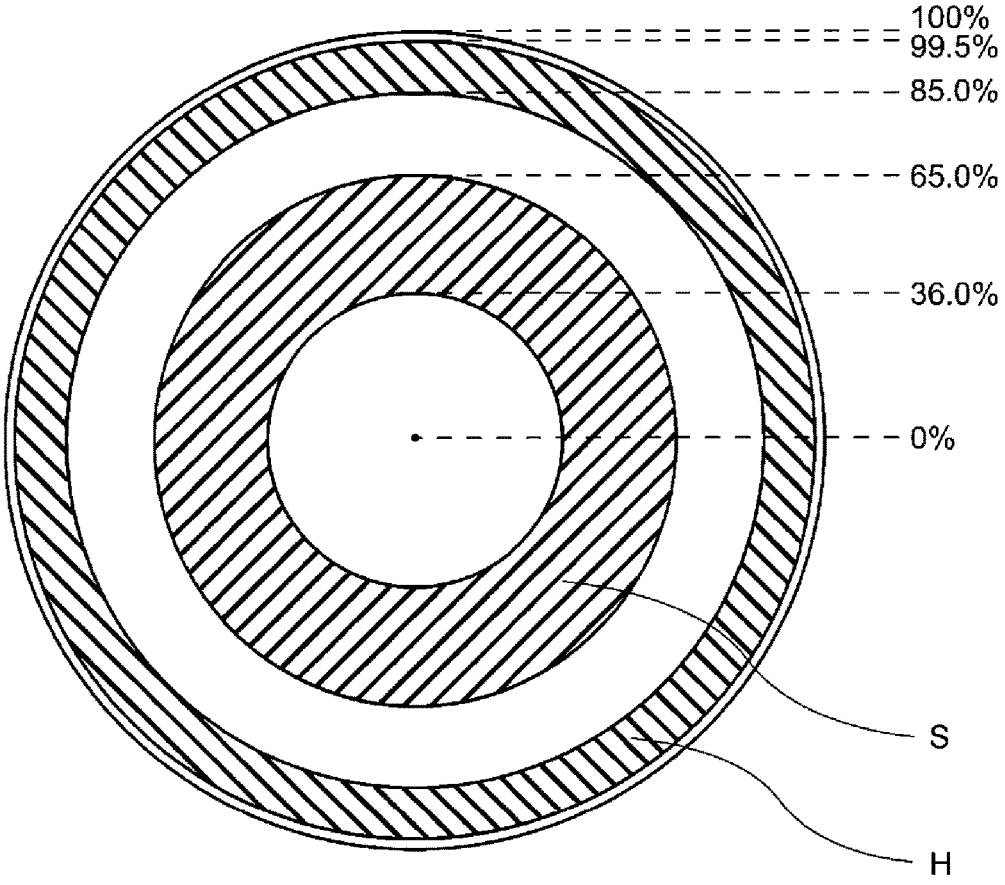
FIG. 2 is a schematic sectional view showing a region H located at a distance from 85.0 to 99.5% of a radius of the golf ball from a center point of the golf ball.

FIG. 2 is a schematic sectional view showing a region H located at a distance from 85.0% to 99.5% of a radius of the golf ball from a center point of the golf ball. In the region H of the golf ball according to the first embodiment shown in FIG. 2, an envelope layer (Eh1) which is formed from a material having a highest material hardness among golf ball constituent materials, is preferably disposed. It is noted that the envelope layer (Eh1) should be disposed as a whole within the region H. When multiple envelope layers are disposed within the region H, at least one layer of the multiple envelope layers is formed from the material having the highest material hardness among the golf ball constituent materials.

When a golf ball having a uniform hardness is hit with a wedge, the region located at a distance from 85.0% to 99.5% of the radius of the golf ball from the center point of the golf ball mostly deforms. If an envelope layer having a high hardness is disposed in this region, the decrease in the spin rate on approach shots can be suppressed. The region where the envelope layer (Eh1) is disposed, is preferably located at a distance of 87.5% or more of the radius of the golf ball from the center point of the golf ball and more preferably located at a distance of 90.0% or more of the radius of the golf ball from the center point of the golf ball, and is preferably located at a distance of 99.0% or less of the radius of the golf ball from the center point of the golf ball and more preferably located at a distance of 98.0% or less of the radius of the golf ball from the center point of the golf ball. The envelope layer (Eh1) is preferably disposed at a position adjacent to the cover.

The thickness of the envelope layer (Eh1) is preferably 0.1 mm or more, more preferably 0.2 mm or more, and even more preferably 0.5 mm or more, and is preferably 5 mm or less, more preferably 4 mm or less, and even more preferably 3 mm or less. If the thickness of the envelope layer (Eh1) is 0.1 mm or more, the durability of the golf ball is sufficiently maintained, and if the thickness of the envelope layer (Eh1) is 5 mm or less, the shot feeling of the golf ball becomes better.

The material hardness (Hh1) of the envelope layer (Eh1) is preferably 30 or more, more preferably 35 or more, even more preferably 40 or more, and particularly preferably 55 or more, and is preferably 85 or less, more preferably 80 or less, and even more preferably 77 or less in Shore D hardness. If the material hardness (Hh1) is 30 or more, the spin rate on driver shots is lowered, and if the material hardness (Hh1) is 85 or less, the shot feeling of the golf ball becomes better.

The hardness (Shore D hardness) ratio (Hh1/Hs1) between the hardness (Hs1) and the hardness (Hh1) is preferably 1.1 or more, more preferably 1.2 or more, and even more preferably 1.3 or more, and is preferably 45 or less, more preferably 35 or less, and even more preferably 30 or less. If the hardness ratio (Hh1/Hs1) is 1.1 or more, the spin rate on driver shots is effectively lowered, and if the hardness ratio (Hh1/Hs1) is 45 or less, the shot feeling of the golf ball becomes better.

The hardness difference (Hh1−Hs1) between the hardness (Hs1) and the hardness (Hh1) is preferably 30 or more, more preferably 32 or more, and even more preferably 34 or more, and is preferably 80 or less, more preferably 75 or less, and even more preferably 70 or less in Shore D hardness. If the hardness difference (Hh1−Hs1) is 30 or more in Shore D hardness, the spin rate on driver shots is effectively lowered, and if the hardness difference (Hh1−Hs1) is 80 or less in Shore D hardness, the shot feeling of the golf ball becomes better.

The material hardness (Ho1) of the spherical center is preferably 15 or more, more preferably 20 or more, even more preferably 25 or more, and particularly preferably 30 or more, and is preferably 55 or less, more preferably 50 or less, and even more preferably 45 or less in Shore D hardness. If the material hardness (Ho1) of the spherical center falls within the above range, the resilience of the golf ball is not lowered.

The hardness (Shore D hardness) ratio (Ho1/Hs1) between the hardness (Hs1) and the hardness (Ho1) is preferably 1.05 or more, more preferably 1.10 or more, and even more preferably 1.15 or more, and is preferably 30 or less, more preferably 20 or less, and even more preferably 10 or less. If the hardness ratio (Ho1/Hs1) is 1.05 or more, the spin rate on driver shots is effectively lowered, and if the hardness ratio (Ho1/Hs1) is 30 or less, the durability of the golf ball is sufficiently maintained.

The hardness difference (Ho1−Hs1) between the hardness (Hs1)) and the hardness (Ho1) is preferably 1 or more, more preferably 2 or more, even more preferably 3 or more, and particularly preferably 10 or more, and is preferably 50 or less, more preferably 45 or less, and even more preferably 40 or less in Shore D hardness. If the hardness difference (Ho1−Hs1) is 1 or more in Shore D hardness, the spin rate on driver shots is effectively lowered, and if the hardness difference (Ho1−Hs1) is 50 or less in Shore D hardness, the durability of the golf ball is sufficiently maintained.

The hardness (Shore D hardness) ratio (Hh1/Ho1) between the hardness (Hh1) and the hardness (Ho1)) is preferably 1.0 or more, more preferably 1.1 or more, and even more preferably 1.2 or more, and is preferably 45 or less, more preferably 40 or less, and even more preferably 35 or less. If the hardness ratio (Hh1/Ho1) is 1.0 or more, the spin rate on driver shots is effectively lowered, and if the hardness ratio (Hh1/Ho1) is 45 or less, the durability of the golf ball is sufficiently maintained.

The hardness difference (Hh1−Ho1) between the hardness (Hh1) and the hardness (Ho1)) is preferably 1 or more, more preferably 5 or more, and even more preferably 10 or more, and is preferably 70 or less, more preferably 65 or less, and even more preferably 60 or less in Shore D hardness. If the hardness difference (Hh1−Ho1) is 1 or more in Shore D hardness, the spin rate on driver shots is effectively lowered, and if the hardness difference (Hh1−Ho1) is 70 or less in Shore D hardness, the resilience of the golf ball is not lowered.

The diameter of the spherical center is preferably 5 mm or more, more preferably 7 mm or more, and even more preferably 10 mm or more, and is preferably 25 mm or less, more preferably 22 mm or less, and even more preferably 15 mm or less. If the diameter of the spherical center is 5 mm or more, the spin rate on driver shots is further lowered. On the other hand, if the diameter of the spherical center is 25 mm or less, the spin rate on approach shots is hardly lowered.

When the center has a diameter in a range from 5 mm to 25 mm, the compression deformation amount (shrinking amount of the center along the compression direction) of the center when applying a load from 98 N as an initial load to 1275 N as a final load to the center is preferably 1.5 mm or more, more preferably 1.7 mm or more, and even more preferably 2.0 mm or more, and is preferably 5.0 mm or less, more preferably 4.7 mm or less, and even more preferably 4.5 mm or less. If the compression deformation amount is 1.5 mm or more, the shot feeling becomes better, while if the compression deformation amount is 5.0 mm or less, the resilience of the golf ball becomes better.

In the case that another envelope layer (E11)) is disposed between the spherical center and the envelope layer (Es1), the hardness (H11) of the material forming the envelope layer (E11) is preferably higher than the hardness (Hs1)) and smaller than the hardness (Ho1)) (Hs1<H11<Ho1). In addition, in the case that another envelope layer (E21) is disposed between the envelope layer (Es1) and the envelope layer (Eh1), the hardness (H21) of the material forming the envelope layer (E21) is preferably higher than the hardness (Hs1)) and smaller than the hardness (Hh1) (Hs1<H21<Hh1).

The thickness of the envelope layer other than the envelope layer (Es1) and the envelope layer (Eh1) is not particularly limited, and is preferably 0.1 mm or more, more preferably 0.2 mm or more, and even more preferably 0.3 mm or more, and is preferably 15 mm or less, more preferably 13 mm or less, and even more preferably 10 mm or less.

The material hardness of each constituent member disposed in the whole region located at a distance from 34.0% to 65.0% of the radius of the golf ball from the center point of the golf ball is preferably lower than 45, more preferably 40 or less, and even more preferably 35 or less in Shore D hardness. If the material hardness of each constituent member disposed in the whole region located at a distance from 34% to 65.0% of the radius of the golf ball from the center point of the golf ball is lower than 45 in Shore D hardness, decrease in the spin rate on driver shots and increase in the spin rate on approach shots can be achieved at a higher level.

The material hardness (Hc1) of the cover is preferably 5 or more, more preferably 7 or more, and even more preferably 10 or more, and is preferably 55 or less, more preferably 53 or less, and even more preferably 50 or less in Shore D hardness. If the material hardness (Hc1) of the cover falls within the above range, the spin rate on approach shots is further increased. The material hardness (Hc1) is preferably smaller than the material hardness (Hh1) (Hc1<Hh1).

The thickness of the cover is preferably 2.0 mm or less, more preferably 1.6 mm or less, even more preferably 1.2 mm or less, and particularly preferably 1.0 mm or less. If the thickness of the cover is 2.0 mm or less, the resilience and shot feeling of the obtained golf ball become better. The thickness of the cover is preferably 0.1 mm or more, more preferably 0.2 mm or more, and even more preferably 0.3 mm or more. If the thickness of the cover is less than 0.1 mm, molding the cover may become difficult, and the durability and wear resistance of the cover may deteriorate.

Examples of the structure of the golf ball according to the first embodiment include: a four-piece golf ball comprising a spherical center, two envelope layers covering the spherical center, and a cover covering the envelope layers; a five-piece golf ball comprising a spherical center, three envelope layers covering the spherical center, and a cover covering the envelope layers; a six-piece golf ball comprising a spherical center, four envelope layers covering the spherical center, and a cover covering the envelope layers; and a seven-piece golf ball comprising a spherical center, five envelope layers covering the spherical center, and a cover covering the envelope layers; and the like.

Examples of the constituent material combination of the golf ball include: an embodiment in which the spherical center and the envelope layer (Es1) are formed from a thermoplastic resin composition; an embodiment in which the spherical center and the envelope layer (Es1) are formed from a rubber composition; an embodiment in which the spherical center is formed from a thermoplastic resin composition, and the envelope layer (Es1) is formed from a rubber composition; an embodiment in which the spherical center is formed from a rubber composition, and the envelope layer (Es1) is formed from a thermoplastic resin composition; and the like. It is preferable that the envelope layer (Eh1) is formed from a thermoplastic resin composition.

Figure 3:
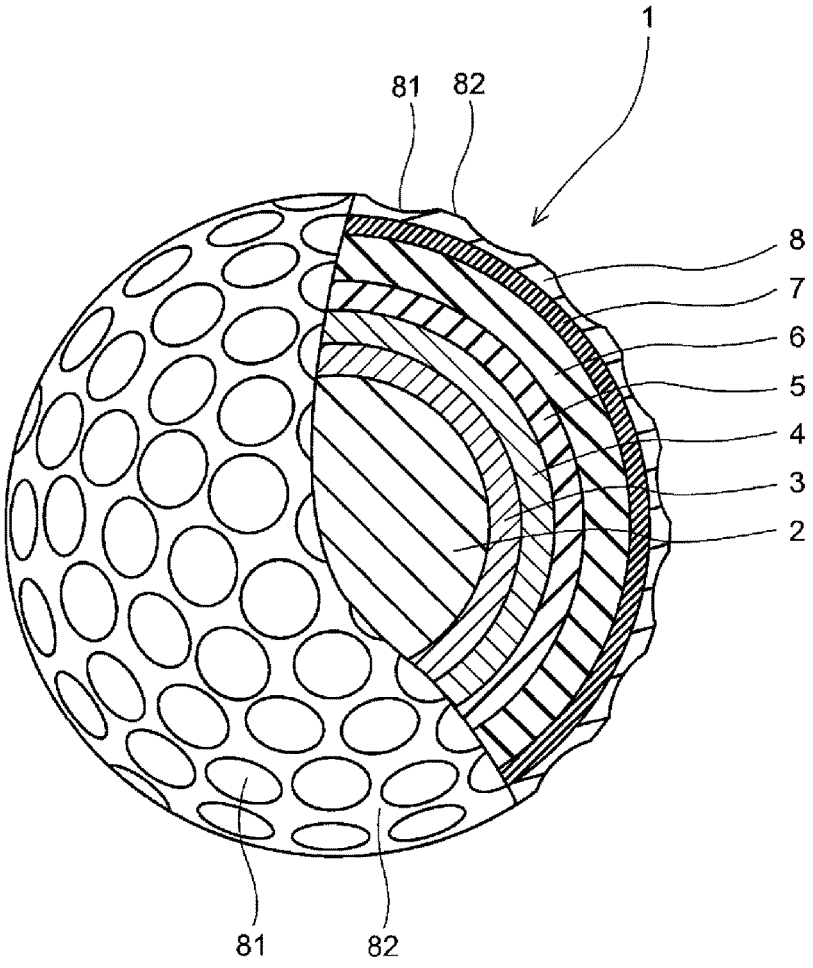
FIG. 3 is a partially cutaway view of a golf ball of one embodiment according to the present invention.

FIG. 3 is a partially cutaway view of a golf ball 1 of one embodiment according to the present invention. The golf ball 1 comprises a spherical center 2, a first envelope layer 3 disposed on the outer side of the spherical center 2, a second envelope layer 4 disposed on the outer side of the first envelope layer 3, a third envelope layer 5 disposed on the outer side of the second envelope layer 4, a fourth envelope layer 6 disposed on the outer side of the third envelope layer 5, a fifth envelope layer 7 disposed on the outer side of the fourth envelope layer 6, and a cover 8 disposed on the outer side of the fifth envelope layer 7. A plurality of dimples 81 are formed on the surface of the cover 8. Other portions than dimples 81 on the surface of the cover 8 are land 82. In the case of a seven-piece golf ball, it is preferred that the second envelope layer is the envelope layer (Es1) and the fifth envelope layer is the envelope layer (Eh1).

(2) Structure of Golf Ball According to the Second Embodiment

The golf ball according to the second embodiment of the present invention comprises a low-elastic-modulus layer (Es2) formed from a material having a tensile elastic modulus in a range from 1 MPa to 20 MPa, wherein the low-elastic-modulus layer (Es2) is disposed in a region located at a distance from 36.0% to 65.0% of a radius of the golf ball from a center point of the golf ball. It is noted that the low-elastic-modulus layer itself means a molded constituent member. For example, a part that is part of a single-structure core and is present in the region located at a distance from 36.0% to 65.0% of the radius of the golf ball from the center point of the golf ball, is not a layer. In other words, the golf ball according to the second embodiment at least comprises a spherical center, the above low-elastic-modulus layer and an outermost layer.

The structure of the golf ball according to the second embodiment is not particularly limited, as long as the low-elastic-modulus layer formed from the material having a tensile elastic modulus in a range from 1 MPa to 20 MPa is disposed in the region S located at a distance from 36.0% to 65.0% of the radius of the golf ball from the center point of the golf ball. The golf ball according to the second embodiment preferably comprises, for example, a spherical center, at least two envelope layers covering the spherical center, and a single-layered cover covering the envelope layers. The envelope layers preferably comprise at least three layers and more preferably comprise at least four layers, and preferably comprise at most ten layers and more preferably comprise at most nine layers. If the envelope layers comprise at least three layers, the hardness distribution of the golf ball becomes easily controlled. On the other hand, if the number of the envelope layers is excessively large, the moldability of the envelope layers is lowered. It is noted that a paint film and a reinforcement layer (adhesive agent layer) that is provided to improve adhesion between the envelope layers are not included in the envelope layers. The paint film and the reinforcement layer (adhesive agent layer) have a different film thickness range from the envelope layers. The paint film and the reinforcement layer (adhesive agent layer) generally have a film thickness of 50 μm (0.050 mm) or less.

In the region S of the golf ball according to the second embodiment shown in FIG. 1, a low-elastic-modulus layer (Es2) which is formed from a material having a tensile elastic modulus in a range from 1 MPa to 20 MPa is disposed. It is noted that the low-elastic-modulus layer (Es2) should be disposed as a whole within the region S.

In the golf ball according to the second embodiment, when multiple envelope layers are disposed within the region S located at a distance from 36.0% to 65.0% of the radius of the golf ball from the center point of the golf ball, at least one layer of the multiple envelope layers is the low-elastic-modulus layer formed from the material having a tensile elastic modulus in a range from 1 MPa to 20 MPa. It is noted that the low-elastic-modulus layer (Es2) should be disposed as a whole within the region S.

When a golf ball having a uniform hardness is hit with a driver, the region S located at a distance from 36.0% to 65.0% of the radius of the golf ball from the center point of the golf ball mostly deforms. If a low-elastic-modulus layer having a low tensile elastic modulus is disposed in this region S, the spin rate on driver shots can be selectively lowered. As a result, a golf ball that has a small ratio of a spin rate on driver shots to a spin rate on approach shots, is obtained. The region S where the low-elastic-modulus layer (Es2) is disposed, is preferably located at a distance of 40.0% or more of the radius of the golf ball from the center point of the golf ball and more preferably located at a distance of 45.0% or more of the radius of the golf ball from the center point of the golf ball, and is preferably located at a distance of 63.0% or less of the radius of the golf ball from the center point of the golf ball and more preferably located at a distance of 60.0% or more of the radius of the golf ball from the center point of the golf ball.

The thickness of the low-elastic-modulus layer (Es2) is preferably 0.2 mm or more, more preferably 0.5 mm or more, and even more preferably 1 mm or more, and is preferably 20 mm or less, more preferably 17 mm or less, and even more preferably 15 mm or less. If the thickness of the low-elastic-modulus layer (Es2) is 0.2 mm or more, the spin rate on driver shots is easily lowered, and if the thickness of the low-elastic-modulus layer (Es2) is 20 mm or less, the resilience of the golf ball is not lowered.

The tensile elastic modulus of the material forming the low elastic-modulus layer is preferably 1 MPa or more, more preferably 2 MPa or more, and even more preferably 3 MPa or more, and is preferably 20 MPa or less, more preferably 18 MPa or less, and even more preferably 16 MPa or less. If the tensile elastic modulus is 1 MPa or more, the resilience of the golf ball is not lowered, and if the tensile elastic modulus is 20 MPa or less, the spin rate on driver shots is easily lowered. The tensile elastic modulus of the material forming the low elastic-modulus layer is preferably a lowest tensile elastic modulus among the tensile elastic modulus of the material forming a constituent member disposed at a region located at a distance from 0% to 95% (more preferably 0% to 97.5%, and even more preferably 0% to 99.5%) of the radius of the golf ball from the center point of the golf ball.

The material hardness of each constituent member disposed in a whole region located at a distance from 34.0% to 65.0% of the radius of the golf ball from the center point of the golf ball is preferably smaller than 45, more preferably 40 or less, and even more preferably 35 or less in Shore D hardness. If the material hardness of each constituent member disposed in the whole region located at a distance from 34.0% to 65.0% of the radius of the golf ball from the center point of the golf ball is smaller than 45 in Shore D hardness, decrease in the spin rate on driver shots and increase in the spin rate on approach shots can be achieved at a higher level. In addition, it is also preferred that each constituent member that is disposed in the whole region located at a distance from 34.0% to 65.0% of the radius of the golf ball from the center point of the golf ball and that has a material hardness lower than 45 in Shore D hardness is entirely present in the region located at a distance from 34% to 65.0% of the radius of the golf ball from the center point of the golf ball.

In the golf ball according to the second embodiment, a high-hardness layer (Eh2) that is formed from a resin material having a highest hardness among resin materials for constituting the golf ball, is preferably disposed in the region H shown in FIG. 2. It is noted that the high-hardness layer (Eh2) should be disposed as a whole within the region H.

In the golf ball according to the second embodiment, when multiple envelope layers are disposed within the region H located at a distance from 85.0% to 99.5% of the radius of the golf ball from the center point of the golf ball, at least one layer of the multiple envelope layers is the high-hardness layer formed from the resin material having a highest hardness among the resin materials for constituting the golf ball. It is noted that the high-hardness layer (Eh2) should be disposed as a whole within the region H.

When a golf ball having a uniform hardness is hit with a wedge, the region H located at a distance from 85.0% to 99.5% of the radius of the golf ball from the center point of the golf ball mostly deforms. If a high-hardness layer (Eh2) having a high hardness is disposed in this region, the decrease in the spin rate on approach shots can be suppressed. The region where the high-hardness layer (Eh2) is disposed, is preferably located at a distance of 87.5% or more of the radius of the golf ball from the center point of the golf ball and more preferably located at a distance of 90.0% or more of the radius of the golf ball from the center point of the golf ball, and is preferably located at a distance of 99.0% or less of the radius of the golf ball from the center point of the golf ball and more preferably located at a distance of 98.0% or less of the radius of the golf ball from the center point of the golf ball. The high-hardness layer (Eh2) is preferably disposed at a position adjacent to the cover (outermost layer of the golf ball body).

The thickness of the high-hardness layer (Eh2) is preferably 0.1 mm or more, more preferably 0.2 mm or more, and even more preferably 0.5 mm or more, and is preferably 5 mm or less, more preferably 4 mm or less, and even more preferably 3 mm or less. If the thickness of the high-hardness layer (Eh2) is 0.1 mm or more, the durability of the golf ball is maintained, and if the thickness of the high-hardness layer (Eh2) is 5 mm or less, the shot feeling of the golf ball becomes better.

The hardness (Hh2) of the material forming the high-hardness layer is preferably 30 or more, more preferably 35 or more, and even more preferably 40 or more, and is preferably 85 or less, more preferably 80 or less, and even more preferably 77 or less in Shore D hardness. If the hardness (Hh2) is 30 or more, the spin rate on driver shots is easily lowered, and if the hardness (Hh2) is 85 or less, the shot feeling of the golf ball becomes better.

The tensile elastic modulus of the material forming the high-hardness layer is preferably 150 MPa or more and more preferably 200 MPa or more, and is preferably 400 MPa or less and more preferably 300 MPa or less. The ratio (high-hardness layer/low-elastic-modulus layer) between the tensile elastic modulus of the material forming the low-elastic-modulus layer and the tensile elastic modulus of the material forming the high-hardness layer is preferably 8 or more and more preferably 10 or more, and is preferably 50 or less and more preferably 40 or less.

The center hardness (Ho2) of the golf ball is preferably 15 or more, more preferably 20 or more, and even more preferably 30 or more, and is preferably 55 or less, more preferably 50 or less, and even more preferably smaller than 45 in Shore D hardness. If the center hardness (Ho2) of the golf ball falls within the above range, the resilience of the golf ball is not lowered. It is noted that the center hardness (Ho2) of the golf ball is a value obtained by cutting the golf ball into two hemispheres and measuring the hardness at the center of the cut plane.

The tensile elastic modulus of the material forming the spherical center is preferably 15 MPa or more and more preferably 20 MPa or more, and is preferably 80 MPa or less and more preferably 60 MPa or less. The ratio (spherical center/low-elastic-modulus layer) between the tensile elastic modulus of the material forming the low-elastic-modulus layer and the tensile elastic modulus of the material forming the spherical center is preferably 1.2 or more and more preferably 1.5 or more, and is preferably 10 or less and more preferably 8 or less.

The ratio (Hh2/Ho2) between the material hardness (Hh2) of the high-hardness layer and the center hardness (Ho2) of the golf ball is preferably 1.0 or more, more preferably 1.1 or more, and even more preferably 1.2 or more, and is preferably 45 or less, more preferably 40 or less, and even more preferably 35 or less. If the ratio (Hh2/Ho2) is 1.0 or more, the spin rate on driver shots is easily lowered, and if the ratio (Hh2/Ho2) is 45 or less, the durability of the golf ball becomes better.

The hardness difference (Hh2−Ho2) between the material hardness (Hh2) of the high-hardness layer and the center hardness (Ho2) of the golf ball is preferably 10 or more, more preferably 15 or more, and even more preferably 20 or more, and is preferably 70 or less, more preferably 65 or less, and even more preferably 60 or less in Shore D hardness. If the hardness difference (Hh2−Ho2) is 10 or more in Shore D hardness, the spin rate on driver shots is easily lowered, and if the hardness difference (Hh2−Ho2) is 70 or less in Shore D hardness, the resilience of the golf ball is not lowered.

The diameter of the spherical center is preferably 5 mm or more, more preferably 7 mm or more, and even more preferably 10 mm or more, and is preferably 25 mm or less, more preferably 22 mm or less, and even more preferably 15 mm or less. If the diameter of the spherical center is 5 mm or more, the spin rate on driver shots is further lowered. On the other hand, if the diameter of the spherical center is 25 mm or less, the spin rate on approach shots is hardly lowered.

When the center has a diameter in a range from 5 mm to 25 mm, the compression deformation amount (shrinking amount of the center along the compression direction) of the center when applying a load from 98 N as an initial load to 1275 N as a final load to the center is preferably 1.5 mm or more, more preferably 1.7 mm or more, and even more preferably 2.0 mm or more, and is preferably 5.0 mm or less, more preferably 4.7 mm or less, and even more preferably 4.5 mm or less. If the compression deformation amount is 1.5 mm or more, the shot feeling becomes better, while if the compression deformation amount is 5.0 mm or less, the resilience of the golf ball becomes better.

The thickness of the envelope layer other than the low-elastic-modulus layer (Es2) and the high-hardness layer (Eh2) is not particularly limited, and is preferably 0.1 mm or more, more preferably 02 mm or more, and even more preferably 0.3 mm or more, and is preferably 15 mm or less, more preferably 13 mm or less, and even more preferably 10 mm or less.

The material hardness (Hc2) of the cover is preferably 5 or more, more preferably 7 or more, and even more preferably 10 or more, and is preferably 55 or less, more preferably 53 or less, and even more preferably 50 or less in Shore D hardness. If the material hardness (Hc2) of the cover falls within the above range, the spin rate on approach shots is further increased.

The thickness of the cover is preferably 2.0 mm or less, more preferably 1.6 mm or less, even more preferably 1.2 mm or less, and particularly preferably 1.0 mm or less. If the thickness of the cover is 2.0 mm or less, the resilience and shot feeling of the obtained golf ball become better. The thickness of the cover is preferably 0.1 mm or more, more preferably 0.2 mm or more, and even more preferably 0.3 mm or more. If the thickness of the over is less than 0.1 mm, molding the cover may become difficult, and the durability and wear resistance of the cover may deteriorate.

Examples of the structure of the golf ball according to the second embodiment include: a four-piece golf ball comprising a spherical center, two envelope layers covering the spherical center, and a cover covering the envelope layers; a five-piece golf ball comprising a spherical center, three envelope layers covering the spherical center, and a cover covering the envelope layers; a six-piece golf ball comprising a spherical center, four envelope layers covering the spherical center, and a cover covering the envelope layers; and a seven-piece golf ball comprising a spherical center, five envelope layers covering the spherical center, and a cover covering the envelope layers; and the like.

Examples of the constituent material combination of the golf ball include: an embodiment in which the spherical center and the low-elastic-modulus layer (Es2) are formed from a thermoplastic resin composition; an embodiment in which the spherical center and the low-elastic-modulus layer (Es2) are formed from a rubber composition; an embodiment in which the spherical center is formed from a thermoplastic resin composition, and the low-elastic-modulus layer (Es2) is formed from a rubber composition; an embodiment in which the spherical center is formed from a rubber composition, and the low-elastic-modulus layer (Es2) is formed from a thermoplastic resin composition; and the like. It is preferable that the high-hardness layer (Eh2) is formed from a thermoplastic resin composition.

FIG. 3 is a partially cutaway view of a golf ball 1 of one embodiment according to the present invention. In the case of a seven-piece golf ball, it is preferred that the second envelope layer is the low-elastic-modulus layer (Es2) and the fifth envelope layer is the high-hardness layer (Eh2).

The golf ball according to the first embodiment and the second embodiment preferably has a diameter ranging from 40 mm to 45 mm. In light of satisfying the regulation of US Golf Association (USGA), the diameter is mostly preferably 42.67 mm or more. In light of prevention of air resistance, the diameter is more preferably 44 mm or less, and mostly preferably 42.80 mm or less. In addition, the golf ball preferably has a mass of 40 g or more and 50 g or less. In light of obtaining greater inertia, the mass is more preferably 44 g or more, and mostly preferably 45.00 g or more. In light of satisfying the regulation of USGA, the mass is mostly preferably 45.93 g or less. When the golf ball according to the first embodiment and the second embodiment has a diameter in a range from 40 mm to 45 mm, the compression deformation amount (shrinking amount along the compression direction) of the golf ball when applying a load from 98 N as an initial load to 1275 N as a final load to the golf ball is preferably 2.0 mm or more and more preferably 2.2 mm or more, and is preferably 4.0 mm or less and more preferably 3.5 mm or less. If the compression deformation amount is 2.0 mm or more, the golf ball does not become excessively hard, so the shot feeling thereof becomes better. On the other hand, if the compression deformation amount is 4.0 mm or less, the resilience of the golf ball becomes better.

(3) Golf Ball Constituent Material

The constituent materials constituting the golf ball according to the present invention will be described. Examples of the constituent materials constituting the golf ball according to the present invention include a thermoplastic resin composition and a rubber composition. The spherical center, envelope layer, and cover may be formed by using these materials. The material hardness of each material can be adjusted by changing the material formulation.

Thermoplastic Resin Composition

Firstly, the thermoplastic resin composition used in the present invention will be explained. (A) The resin component contained in the thermoplastic resin composition is not particularly limited, as long as it is a thermoplastic resin. Examples of the thermoplastic resin include, for example, a thermoplastic resin such as an ionomer resin, a thermoplastic olefin copolymer, a thermoplastic polyurethane resin, a thermoplastic polyamide resin, a thermoplastic styrene-based resin, a thermoplastic polyester resin, a thermoplastic acrylic resin, and the like. Among these thermoplastic resins, a thermoplastic elastomer having rubber elasticity is preferable. Examples of the thermoplastic elastomer include, for example, a thermoplastic polyurethane elastomer, a thermoplastic polyamide elastomer, a thermoplastic styrene-based elastomer, a thermoplastic polyester elastomer, a thermoplastic acrylic-based elastomer, and the like.

(3-1) Ionomer Resin

Examples of the ionomer resin include: an ionomer resin consisting of a metal ion-neutralized product of a binary copolymer composed of an olefin and an α,β-unsaturated carboxylic acid having 3 to 8 carbon atoms; an ionomer resin consisting of a metal ion-neutralized product of a ternary copolymer composed of an olefin, an α,β-unsaturated carboxylic acid having 3 to 8 carbon atoms and an α,β-unsaturated carboxylic acid ester; or a mixture thereof.

In the present invention, "the ionomer resin consisting of a metal ion-neutralized product of a binary copolymer composed of an olefin and an α,β-unsaturated carboxylic acid having 3 to 8 carbon atoms" is sometimes merely referred to as "the binary ionomer resin", and the ionomer resin consisting of a metal ion-neutralized product of a ternary copolymer composed of an olefin, an α,β-unsaturated carboxylic acid having 3 to 8 carbon atoms and an α,β-unsaturated carboxylic acid ester is sometimes merely referred to as "the ternary ionomer resin".

The olefin is preferably an olefin having 2 to 8 carbon atoms. Examples of the olefin include, for example, ethylene, propylene, butene, pentene, hexene, heptane and octane, and ethylene is particularly preferred. Examples of the α,β-unsaturated carboxylic acid having 3 to 8 carbon atoms include, for example, acrylic acid, methacrylic acid, fumaric acid, maleic acid and crotonic acid, and acrylic acid and methacrylic acid are particularly preferred. In addition, examples of the α,β-unsaturated carboxylic acid ester include, for example, methyl ester, ethyl ester, propyl ester, n-butyl ester, isobutyl ester of acrylic acid, methacrylic acid, fumaric acid and maleic acid, and acrylic acid ester and methacrylic acid ester are particularly preferred.

The binary ionomer resin is preferably a metal ion-neutralized product of a binary copolymer composed of ethylene-(meth)acrylic acid. The ternary ionomer resin is preferably a metal ion-neutralized product of a ternary copolymer composed of ethylene, (meth)acrylic acid and (meth)acrylic acid ester. Here, (meth)acrylic acid means acrylic acid and/or methacrylic acid.

The content of the α,β-unsaturated carboxylic acid component having 3 to 8 carbon atoms in the binary ionomer resin is preferably 15 mass % or more, more preferably 16 mass % or more, and even more preferably 17 mass % or more, and is preferably 30 mass % or less, more preferably 25 mass % or less. If the content of the α,β-unsaturated carboxylic acid component having 3 to 8 carbon atoms is 15 mass % or more, the resultant constituent member has a desirable hardness. If the content of the α,β-unsaturated carboxylic acid component having 3 to 8 carbon atoms is 30 mass % or less, since the hardness of the resultant constituent member does not become excessively high, the durability and the shot feeling thereof become better.

The degree of neutralization of the carboxyl groups of the binary ionomer resin is preferably 15 mole % or more, more preferably 20 mole % or more, and is preferably 100 mole % or less. If the degree of neutralization is 15 mole % or more, the resultant golf ball has better resilience and durability. The degree of neutralization of the carboxyl groups of the binary ionomer resin can be calculated by the following expression. Sometimes, the metal component is contained in such an amount that the theoretical degree of neutralization of the carboxyl groups contained in the ionomer resin exceeds 100 mole %.

Degree of neutralization (mole %) of the binary ionomer resin=100×the number of moles of carboxyl groups neutralized in the binary ionomer resin/the number of moles of all carboxyl groups contained in the binary ionomer resin Examples of the metal ion used for neutralizing at least a part of carboxyl groups of the binary ionomer resin include: a monovalent metal ion such as sodium, potassium, lithium; a divalent metal ion such as magnesium, calcium, zinc, barium, cadmium; a trivalent metal ion such as aluminum; and other ion such as tin, zirconium.

Specific examples of the binary ionomer resin include trade name "Himilan (registered trademark) (e.g. Himilan 1555 (Na), Himilan 1557 (Zn), Himilan 1605 (Na), Himilan 1706 (Zn), Himilan 1707 (Na), Himilan AM7311 (Mg), Himilan AM7329 (Zn))" commercially available from Mitsui-Du Pont Polychemicals Co., Ltd.

Further, examples include "Surlyn (registered trademark) (e.g. Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li))" commercially available from E.I. du Pont de Nemours and Company.

Further, examples include "lotek (registered trademark) (e.g. lotek 8000 (Na), lotek 8030 (Na), lotek 7010 (Zn), lotek 7030 (Zn))" commercially available from ExxonMobil Chemical Corporation.

The binary ionomer resins may be used alone or as a mixture of at least two of them. It is noted that Na, Zn, Li and Mg described in the parentheses after the trade names indicate metal types of neutralizing metal ions of the binary ionomer resins.

The binary ionomer resin preferably has a bending stiffness of 140 MPa or more, more preferably 150 MPa or more, and even more preferably 160 MPa or more, and preferably has a bending stiffness of 550 MPa or less, more preferably 500 MPa or less, even more preferably 450 MPa or less. If the bending stiffness of the binary ionomer resin is excessively low, the flight distance tends to be shorter because of the increased spin rate of the golf ball. If the bending stiffness is excessively high, the durability of the golf ball may be lowered.

The binary ionomer resin preferably has a melt flow rate (190° C., 2.16 kgf) of 0.1 g/10 min or more, more preferably 0.5 g/10 min or more, even more preferably 1.0 g/10 min or more, and preferably has a melt flow rate (190° C., 2.16 kgf) of 30 g/10 min or less, more preferably 20 g/10 min or less, even more preferably 15 g/10 min or less. If the melt flow rate (190° C., 2.16 kgf) of the binary ionomer resin is 0.1 g/10 min or more, the thermoplastic resin composition has better fluidity, thus, for example, molding a thin layer becomes possible. If the melt flow rate (190° C., 2.16 kgf) of the binary ionomer resin is 30 g/10 min or less, the durability of the resultant golf ball becomes better.

The content of the α,β-unsaturated carboxylic acid component having 3 to 8 carbon atoms in the ternary ionomer resin is preferably 2 mass % or more, more preferably 3 mass % or more, and is preferably 30 mass % or less, more preferably 25 mass % or less.

The degree of neutralization of the carboxyl groups of the ternary ionomer resin is preferably 20 mole % or more, more preferably 30 mole % or more, and is preferably 100 mole % or less. If the degree of neutralization is 20 mole % or more, the resultant golf ball obtained by using the thermoplastic resin composition has better resilience and durability. The degree of neutralization of the carboxyl groups of the ionomer resin can be calculated by the following expression. Sometimes, the metal component is contained in such an amount that the theoretical degree of neutralization of the carboxyl groups of the ionomer resin exceeds 100 mole %.

Degree of neutralization (mole %) of the ionomer resin=100×the number of moles of carboxyl groups neutralized in the ionomer resin the number of moles of all carboxyl groups contained in the ionomer resin Examples of the metal on used for neutralizing at least a part of carboxyl groups of the ternary ionomer resin include: a monovalent metal ion such as sodium, potassium, lithium; a divalent metal on such as magnesium, calcium, zinc, barium, cadmium; a trivalent metal on such as aluminum; and other ion such as tin, zirconium.

Specific examples of the ternary ionomer resin include trade name "Himilan (registered trademark) (e.g. Himilan AM7327 (Zn), Himilan 1855 (Zn), Himilan 1856 (Na), Himilan AM7331 (Na))" commercially available from Mitsui-Du Pont Polychemicals Co., Ltd. Further, the ternary ionomer resins commercially available from E.I. du Pont de Nemours and Company include "Surlyn 6320 (Mg), Surlyn 8120 (Na), Surlyn 8320 (Na), Surlyn 9320 (Zn), Surlyn 9320W (Zn), HPF1000 (Mg), HPF2000 (Mg) or the like". The ternary ionomer resins commercially available from ExxonMobil Chemical Corporation include "lotek 7510 (Zn), lotek 7520 (Zn) or the like". It is noted that Na, Zn and Mg described in the parentheses after the trade names indicate metal types of neutralizing metal ions. The ternary ionomer resins may be used alone or as a mixture of at least two of them.

The ternary ionomer resin preferably has a bending stiffness of 10 MPa or more, more preferably 11 MPa or more, even more preferably 12 MPa or more, and preferably has a bending stiffness of 100 MPa or less, more preferably 97 MPa or less, even more preferably 95 MPa or less. If the bending stiffness of the ternary ionomer resin is excessively low, the flight distance tends to be shorter because of the increased spin rate of the golf ball. If the bending stiffness is excessively high, the durability of the golf ball may be lowered.

The ternary ionomer resin preferably has a melt flow rate (190° C., 2.16 kgf) of 0.1 g/10 min or more, more preferably 0.3 g/10 min or more, even more preferably 0.5 g/10 min or more, and preferably has a melt flow rate (190° C., 2.16 kgf) of 20 g/10 min or less, more preferably 15 g/10 min or less, even more preferably 10 g/10 min or less. If the melt flow rate (190° C., 2.16 kgf) of the ternary ionomer resin is 0.1 g/10 min or more, the thermoplastic resin composition has better fluidity, thus it is easy to mold a thin envelope layer. If the melt flow rate (190° C., 2.16 kgf) of the ternary ionomer resin is 20 g/10 min or less, the durability of the resultant golf ball becomes better.

The ternary ionomer resin preferably has a slab hardness of 20 or more, more preferably 25 or more, even more preferably 30 or more, and preferably has a slab hardness of 70 or less, more preferably 65 or less, even more preferably 60 or less in Shore D hardness. If the ternary ionomer resin has a slab hardness of 20 or more in Shore D hardness, the resultant constituent member does not become excessively soft and thus the golf ball has better resilience. If the ternary ionomer resin has a slab hardness of 70 or less in Shore D hardness, the resultant constituent member does not become excessively hard and thus the golf ball has better durability.

(3-2) Thermoplastic Olefin Copolymer

Examples of the thermoplastic olefin copolymer include, for example, a binary copolymer composed of an olefin and an α,β-unsaturated carboxylic acid having 3 to 8 carbon atoms; a ternary copolymer composed of an olefin, an α,β-unsaturated carboxylic acid having 3 to 8 carbon atoms, and an α,β-unsaturated carboxylic acid ester; or a mixture thereof. The thermoplastic olefin copolymer is a nonionic copolymer in which the carboxyl groups are not neutralized.

In the present invention, "the binary copolymer composed of an olefin and an co-unsaturated carboxylic acid having 3 to 8 carbon atoms" is sometimes merely referred to as "the binary copolymer", and "the ternary copolymer composed of an olefin, an α,β-unsaturated carboxylic acid having 3 to 8 carbon atoms, and an α,β-unsaturated carboxylic acid ester" is sometimes merely referred to as "the ternary copolymer".

Examples of the olefin include the same as the olefin constituting the ionomer resin, and ethylene is particularly preferred. Examples of the α,β-unsaturated carboxylic acid having 3 to 8 carbon atoms and the ester include the same as the α,β-unsaturated carboxylic add having 3 to 8 carbon atoms and the ester constituting the ionomer resin.

The binary copolymer is preferably a binary copolymer composed of ethylene and (meth)acrylic add. The ternary copolymer is preferably a ternary copolymer composed of ethylene, (meth)acrylic acid, and (meth)acrylic acid ester. Here, (meth)acrylic acid means acrylic acid and/or methacrylic acid.

The content of the α,β-unsaturated carboxylic acid having 3 to 8 carbon atoms in the binary copolymer or the ternary copolymer is preferably 4 mass % or more, more preferably 5 mass % or more, and is preferably 30 mass % or less, more preferably 25 mass % or less.

The binary copolymer or the ternary copolymer preferably has a melt flow rate (190° C., 2.16 kgf) of 5 g/10 min or more, more preferably 10 g/10 min or more, even more preferably 15 g/10 min or more, and preferably has a melt flow rate (190° C., 2.16 kgf) of 1,700 g/10 min or less, more preferably 1,500 g/10 min or less, even more preferably 1,300 g/10 min or less. If the melt flow rate (190° C., 2.16 kgf) of the binary copolymer or the ternary copolymer is 5 g/10 min or more, the thermoplastic resin composition has better fluidity and thus it is easy to mold a constituent member. If the melt flow rate (190° C., 2.16 kgf) of the binary copolymer or the ternary copolymer is 1,700 g/10 min or less, the resultant golf ball has better durability.

Specific examples of the binary copolymer include: an ethylene-methacrylic acid copolymer having a trade name of "NUCREL (registered trademark) (e.g. "NUCREL N1050H", "NUCREL N2050H", "NUCREL N1110H", "NUCREL N0200H")" commercially available from Mitsui-Du Pont Polychemicals Co., Ltd; an ethylene-acrylic acid copolymer having a trade name of "PRIMACOR (registered trademark) 59801" commercially available from Dow Chemical Company; and the like.

Specific examples of the ternary copolymer include: the ternary copolymer having a trade name of "NUCREL (registered trademark) (e.g. "NUCREL AN4318", "NUCREL AN4319")" commercially available from Mitsui-Du Pont Polychemicals Co., Ltd; the ternary copolymer having a trade name of "NUCREL (registered trademark) (e.g. "NUCREL AE")" commercially available from E.I. du Pont de Nemours and Company; the ternary copolymer having a trade name of "PRIMACOR (registered trademark) (e.g. "PRIMACOR AT310", "PRIMACOR AT320")" commercially available from Dow Chemical Company; and the like. The binary copolymer or the ternary copolymer may be used alone or as a mixture of at least two of them.

(3-3) Thermoplastic Polyurethane Resin and Thermoplastic Polyurethane Elastomer

Examples of the thermoplastic polyurethane resin and the thermoplastic polyurethane elastomer include a thermoplastic resin and a thermoplastic elastomer which have plurality of urethane bonds in the main molecular chain. The polyurethane is preferably a product obtained by a reaction between a polyisocyanate component and a polyol component. Examples of the thermoplastic polyurethane elastomer include, for example, trade names of "Elastollan XNY85A", "Elastollan XNY90A", "Elastollan XNY97A", "Elastollan ET885", and "Elastollan ET890" manufactured by BASF Japan Ltd and the like.

(3-4) Thermoplastic Styrene-Based Elastomer

A thermoplastic elastomer containing a styrene block can be appropriately used as the thermoplastic styrene-based elastomer. The thermoplastic elastomer containing a styrene block has a polystyrene block which is a hard segment, and a soft segment. Typical soft segment is a diene block. Examples of a constituent component of the diene block include butadiene, isoprene, 1,3-pentadiene and 2,3-dimethyl-1,3-butadiene. Butadiene and isoprene are preferable. Two or more constituent components may be used in combination.

The thermoplastic elastomer containing a styrene block includes: a styrene-butadiene-styrene block copolymer (SBS), a styrene-isoprene-styrene block copolymer (SIS), a styrene-isoprene-butadiene-styrene block copolymer (SIBS), a hydrogenated product of SBS, a hydrogenated product of SIS and a hydrogenated product of SIBS. Examples of the hydrogenated product of SBS include a styrene-ethylene-butylene-styrene block copolymer (SEBS). Examples of the hydrogenated product of SIS include a styrene-ethylene-propylene-styrene block copolymer (SEPS). Examples of the hydrogenated product of SIBS include a styrene-ethylene-ethylene-propylene-styrene block copolymer (SEEPS).

The content of the styrene component in the thermoplastic elastomer containing a styrene block is preferably 10 mass % or more, more preferably 12 mass % or more, even more preferably 15 mass % or more. In the view of the shot feeling of the resultant golf ball, the content is preferably 50 mass % or less, more preferably 47 mass % or less, even more preferably 45 mass % or less.

The thermoplastic elastomer containing a styrene block includes an alloy of one kind or two or more kinds selected from the group consisting of SBS, SIS, SIBS, SEBS, SEPS, SEEPS and a hydrogenated product thereof with a polyolefin. It is estimated that the olefin component in the alloy contributes to the improvement in compatibility with the ionomer resin. By using the alloy, the resilience of the golf ball is increased. An olefin having 2 to 10 carbon atoms is preferably used. Appropriate examples of the olefin include ethylene, propylene, butane and pentene. Ethylene and propylene are particularly preferred.

Specific examples of the polymer alloy include the polymer alloys having trade names of "Rabalon T3221C", "Rabalon T3339C", "Rabalon SJ4400N", "Rabalon SJ5400N", "Rabalon SJ6400N", "Rabalon SJ7400N", "Rabalon SJ8400N", "Rabalon SJ9400N" and "Rabalon SR04" manufactured by Mitsubishi Chemical Corporation.

Other specific examples of the thermoplastic elastomer containing a styrene block include "Epofriend A1010" manufactured by Daicel Chernival Industries, Ltd and "Septon HG-252" manufactured by Kuraray Co., Ltd.

(3-5) Thermoplastic Polyamide Resin and Thermoplastic Polyamide Elastomer

The thermoplastic polyamide is not particularly limited, as long as it is a thermoplastic resin having plurality of amide bonds (—NH—CO—) in the main molecular chain. Examples of the thermoplastic polyamide include, for example, a product having an amide bond in the molecule formed by a ring-opening polymerization of lactam or a reaction between a diamine component and a dicarboxylic add component.

Examples of the polyamide resin include, for example, an aliphatic polyamide such as polyamide 6, polyamide 11, polyamide 12, polyamide 66, polyamide 610, polyamide 6T, polyamide 6I, polyamide 9T, polyamide M5T, polyamide 612; and an aromatic polyamide such as poly-p-phenyleneterephthalamide, poly-m-phenyleneisophthalamide. These polyamides may be used alone or in combination of at least two of them. Among them, the aliphatic polyamide such as polyamide 6, polyamide 66, polyamide 11, polyamide 12 is preferable.

Specific examples of the polyamide resin include, for example, the polyamide resin having a trade name of "Rilsan (registered trademark) B (e.g. Rilsan BESN TL, Rilsan BESN P20 TL, Rilsan BESN P40 TL, Rilsan MB3610, Rilsan BMF 0, Rilsan BMN O, Rilsan BMN O TLD, Rilsan BMN BK TLD, Rilsan BMN P20 D, Rilsan BMN P40 D and the like)" commercially available from Arkema Inc., and the like.

The polyamide elastomer has a hard segment part consisting of a polyamide component and a soft segment part. Examples of the soft segment part of the polyamide elastomer include, for example, a polyether ester component or a polyether component. Examples of the polyamide elastomer include, for example, a polyether ester amide obtained by a reaction between a polyamide component (hard segment component) and a polyether ester component (soft segment component) consisting of polyoxyalkylene glycol and dicarboxylic acid; and a polyether amide obtained by a reaction between a polyamide component (hard segment component) and a polyether (soft segment component) consisting of a product obtained by aminating or carboxylating two terminal ends of polyoxyalkylene glycol and dicarboxylic acid or diamine.

Examples of the polyamide elastomer include, for example, "Pebax 2533", "Pebax 3533", "Pebax 4033", "Pebax 5533" manufactured by Arkema Inc. and the like.

(3-6) Thermoplastic Polyester Resin and Thermoplastic Polyester Elastomer

The thermoplastic polyester resin is not particularly limited, as long as it is a thermoplastic resin having plurality of ester bonds in the main molecular chain. For example, a product obtained by a reaction between dicarboxylic add and did is preferable. Examples of the thermoplastic polyester elastomer include, for example, a block copolymer having a hard segment consisting of a polyester component and a soft segment. Examples of the polyester component constituting the hard segment include, for example, an aromatic polyester. Examples of the soft segment component include an aliphatic polyether, an aliphatic polyester and the like.

Specific examples of the polyester elastomer include "Hytrel 3548", "Hytrel 4047" manufactured by Toray-Du Pont Ca, Ltd; "Primalloy A1606", "PrimaHoy B1600", "Primalloy B1700" manufactured by Mitsubishi Chemical Corporation; and the like.

(3-7) Thermoplastic (Meth)Acrylic-Based Elastomer

Examples of the thermoplastic (meth)acrylic-based elastomer include a thermoplastic elastomer obtained by copolymerizing ethylene and (meth)acrylic acid ester. Specific examples of the thermoplastic (meth)acrylic-based elastomer include, for example, "Kurarity (a block copolymer of methyl methacrylate and butyl acrylate)" manufactured by Kuraray Co., Ltd.

The thermoplastic resin composition preferably contains, as the resin component, at least one kind selected from the group consisting of the ionomer resin, the thermoplastic olefin copolymer, the thermoplastic styrene-based elastomer, the thermoplastic polyester elastomer, the thermoplastic polyurethane elastomer, the thermoplastic polyamide elastomer, and the thermoplastic acrylic-based elastomer. This is because a constituent member having a desired hardness can be formed easily.

In the present invention, when the ionomer resin or the thermoplastic olefin copolymer are used as the resin component contained in the thermoplastic resin composition, the thermoplastic resin composition may further contain (B) a basic metal salt of a fatty acid which will be explained below. By containing (B) the basic metal salt of the fatty acid, the degree of neutralization of the ionomer resin and the thermoplastic olefin copolymer can be increased. By increasing the degree of neutralization, the resilience of the resultant constituent member becomes higher.

(B) The basic metal salt of the fatty acid is obtained by a well-known producing method where a fatty add is allowed to react with a metal oxide or metal hydroxide. The conventional metal salt of the fatty acid is obtained by a reaction of the fatty acid with the metal oxide or metal hydroxide in an amount of the reaction equivalent, whereas (B) the basic metal salt of the fatty acid is obtained by adding the metal oxide or metal hydroxide in an excessive amount which is larger than the reaction equivalent to the fatty acid, and the resultant product has a different metal content, melting point or the like from the conventional metal salt of the fatty acid.

As (B) the basic metal salt of the fatty acid, a basic metal salt of a fatty acid represented by the following general formula (1) is preferred.

$$mM^1O.M^2(RCOO)_2 \quad (1)$$

In the formula (1), m represents the number of moles of metal oxides or metal hydroxides in the basic metal salt of the fatty acid. The m preferably ranges from 0.1 to 2.0, and more preferably from 0.2 to 1.5. If m is less than 0.1, the resilience of the obtained resin composition may be lowered, while if m exceeds 2.0, the melting point of the basic metal salt of the fatty acid becomes so high that it may be difficult to disperse to the resin component. $M^1$ and $M^2$ are preferably the group II or the group XII metals of the periodic table, respectively, $M^1$ and $M^2$ may be identical or different from each other. Examples of the group II metals include beryllium, magnesium, calcium, strontium and barium. Examples of the group XII metals include zinc, cadmium and mercury. Preferred is, for example, magnesium, Calcium, barium or zinc, and more preferred is magnesium, as $M^1$ and $M^2$ metals.

In the formula (1). RCOO means the residue of the saturated fatty acid or unsaturated fatty acid. Specific examples of the saturated fatty acid component of (B) the basic metal salt of the fatty acid (IUPAC name) include butanoic acid (C4), pentanoic acid (C5), hexanoic acid (C6), heptanoic acid (C7), octanoic acid (C8), nonanoic acid (C9), decanoic acid (C10), undecanoic acid (C11), dodecanoic acid (C12), tridecanoic acid (C13), tetradecanoic acid (C14), pentadecanoic acid (C15), hexadecanoic acid (C16), heptadecanoic add (C17), octadecanoic add (C18), nonadecanoic add (C19), icosanoic add (C20), henicosanoic add (C21), docosanoic add (C22), tricosanoic add (C23), tetracosanoic add (C24), pentacosanoic add (C25), hexacosanoic add (C26), heptacosanoic add (C27), octacosanoic add (C28), nonacosanoic acid (C29), and triacontanoic acid (C30).

Specific examples of the unsaturated fatty add component of (B) the basic metal salt of the fatty acid (IUPAC name) include butenoic acid (C4), pentenoic acid (C5), hexenoic acid (C6), heptenoic acid (C7), octenoic acid (C8), nonenoic acid (C9), decenoic acid (C10), undecenoic acid (C11), dodecenoic acid (C12), tridecenoic acid (C13), tetradecenoic acid (C14), pentadecenoic acid (C15), hexadecenoic acid (C16), heptadecenoic acid (C17), octadecenoic acid (C18), nonadecenoic acid (C19), icosenoic acid (C20), henicosenoic acid (C21), docosenoic acid (C22), tricosenoic acid (C23), tetracosenoic acid (C24), pentacosenoic acid (C25), hexacosenoic acid (C26), heptacosenoic acid (C27), octacosenoic acid (C28), nonacosenoic acid (C29), and triacontenoic acid (C30).

Specific examples of the fatty acid component of (B) the basic metal salt of the fatty acid (Common name) are, for example, butyric acid (C4), valeric acid (C5), caproic acid (C6), enanthic acid (C7), caprylic acid (C8), pelargonic acid (C9), capric acid (C10), lauric acid (C12), myristic acid (C14), myristoleic acid (C14), pentadecylic acid (C15), palmitic acid (C16), palmitoleic acid (C16), margaric acid (C17), stearic acid (C18), elaidic acid (C18), vaccenic acid (C18), oleic acid (C18), linoleic acid (C18), linolenic acid (C18), 12-hydroxy stearic acid (C18), arachidic acid (C20), gadoleic acid (C20), arachidonic acid (C20), eicosenoic acid (C20), behenic acid (C22), erucic acid (C22), lignoceric acid (C24), nervonic acid (C24), cerotic acid (C26), montanic acid (C28), and melissic acid (C30).

(B) The basic metal salt of the fatty acid is preferably a basic metal salt of an unsaturated fatty acid. The unsaturated fatty acid component preferably includes at least one selected from the group consisting of oleic acid (C18), erucic acid (C22), linoleic acid (C18), linolenic add (C18), arachidonic add (C20), eicosapentaenoic add (C20), docosahexaenoic add (C22), stearidonic add (C18), nervonic add (C24), vaccenic add (C18), gadoleic add (C20), elaidic add (C18), eicosenoic add (C20), eicosadienoic add (C20), docosadienoic add (C22), pinolenic add (C18), eleostearic add (C18), mead add (C20), adrenic add (C22), clupanodonic add (C22), nisinicacid (C24), and tetracosapentaenoic add (C24).

(B) The basic metal salt of the fatty add is preferably a basic metal salt of a fatty acid having 8 to 30 carbon atoms, and more preferably a basic metal salt of a fatty acid having 12 to 24 carbon atoms. Specific examples of (B) the basic metal salt of the fatty acid include basic magnesium laurate, basic calcium laurate, basic zinc laurate, basic magnesium myristate, basic calcium myristate, basic zinc myristate, basic magnesium palmitate, basic calcium palmitate, basic zinc palmitate, basic magnesium oleate, basic calcium oleate, basic zinc oleate, basic magnesium stearate, basic calcium stearate, basic zinc stearate, basic magnesium 12-hydroxystearate, basic calcium 12-hydroxystearate, basic zinc 12-hydroxystearate, basic magnesium behenate, basic calcium behenate, and basic zinc behenate. (B) The basic metal salt of the fatty acid preferably includes a basic magnesium salt of a fatty acid, and more preferably basic magnesium stearate, basic magnesium behenate, basic magnesium laurate, and basic magnesium oleate. (B) The basic metal salt of the fatty acid may be used alone or as a mixture of at least two of them.

There is no particular limitation on the melting point of (B) the basic metal salt of the fatty acid, but if the metal is magnesium, the melting point is preferably 100° C. or more, and is preferably 300° C. or less, more preferably 290° C. or less, even more preferably 280° C. or less. If the melting point falls within the above range, the dispersibility to the resin component becomes better.

(B) The basic metal salt of the fatty acid preferably contains the metal component in an amount of 1 mole % or more, more preferably 1.1 mole % or more, and preferably contains the metal component in an amount of 2 mole % or less, more preferably 1.9 mole % or less. If the content of the metal component falls within the above range, the resilience of the obtained golf ball's constituent member is further increased. The content of the metal component of (B) the basic metal salt of the fatty add is a value calculated by dividing the metal amount (g) contained per 1 mole of the metal salt by the atomic weight of the metal, and is expressed in mole %.

The content of (B) the basic metal salt of the fatty add in the thermoplastic resin composition used in the present invention is preferably 5 parts by mass or more, more preferably 8 parts by mass or more, even more preferably 10 parts by mass or more, and is preferably 100 parts by mass or less, more preferably 90 parts by mass or less, with respect to 100 parts by mass of (A) the resin component. If the content of (B) the basic metal salt of the fatty add is 5 parts by mass or more, the resilience of the golf ball's constituent member is increased, while if the content is 100 parts by mass or less, it is possible to suppress the lowering of the durability of the golf ball's constituent member due to the increase in the low-molecular weight component.

Examples of the resin component constituting the center or the envelope layers preferably include the ionomer resin, the thermoplastic olefin copolymer, the thermoplastic styrene-based elastomer and the mixture thereof. As the resin component, a resin component containing the thermoplastic styrene-based elastomer is preferable. Examples of the thermoplastic styrene-based elastomer preferably include the alloy of one kind or two or more kinds selected from the group consisting of SBS, SIS, SIBS, SEBS, SEPS, SEEPS and the hydrogenated product thereof with the polyolefin. The content of the thermoplastic styrene-based elastomer in the resin component constituting the center is preferably 5 mass % or more, more preferably 10 mass % or more, and is preferably 100 mass % or less, more preferably 80 mass % or less.

Examples of the preferable embodiment of the resin component constituting the center or the envelope layers include the following embodiments.

(1) An embodiment containing the ionomer resin and the thermoplastic styrene-based elastomer as the resin component. In a more preferable embodiment, the ternary ionomer resin and the alloy of one kind or two or more kinds selected from the group consisting of SBS, SIS, SIBS, SEBS, SEPS, SEEPS and the hydrogenated product thereof with the polyolefin are contained.

(2) An embodiment containing the ionomer resin and the thermoplastic styrene-based elastomer, and further containing the basic metal salt of the fatty acid for increasing the degree of neutralization of the ionomer resin. In a more preferable embodiment, the ternary ionomer resin, the alloy of one kind or two or more kinds selected from the group consisting of SBS, SIS, SIBS, SEBS, SEPS, SEEPS and the hydrogenated product thereof with the polyolefin, and further the basic metal salt of the fatty acid for increasing the degree of neutralization of the ionomer resin are contained.

(3) An embodiment containing the thermoplastic olefin copolymer and the thermoplastic styrene-based elastomer, and further containing the basic metal salt of the fatty acid for increasing the degree of neutralization of the thermoplastic olefin copolymer. Examples of the thermoplastic olefin copolymer preferably include the binary copolymer composed of the olefin and the α,β-unsaturated carboxylic acid having 3 to 8 carbon atoms and/or the ternary copolymer composed of the olefin, the α,β-unsaturated carboxylic acid having 3 to 8 carbon atoms and the α,β-unsaturated carboxylic acid ester, Examples of the thermoplastic styrene-based elastomer preferably include the alloy of one kind or two or more kinds selected from the group consisting of SBS, SIS, SIBS, SEBS, SEPS, SEEPS and the hydrogenated product thereof with the polyolefin.

The resin component constituting the second envelope layer preferably contains an ionomer resin and a thermoplastic styrene-based elastomer. A total amount of these resin components is preferably 50 mass % or more, more preferably 70 mass % or more, even more preferably 90 mass % or more. In this case, a mass ratio of the ionomer resin to the thermoplastic styrene-based elastomer (ionomer resin/thermoplastic styrene-based elastomer is preferably 0.1 or more, more preferably 0.2 or more, even more preferably 0.3 or more, and is preferably 3.0 or less, more preferably 1.7 or less, even more preferably 1.2 or less.

The resin component constituting the outermost envelope layer preferably the ionomer resin. The content percentage of the ionomer resin is preferably 50 mass % or more, more preferably 70 mass % or more, even more preferably 90 mass % or more.

The resin component constituting the cover preferably contains an ionomer resin, a thermoplastic polyurethane resin (including a thermoplastic polyurethane elastomer), or a mixture thereof. If the resin component constituting the cover contains the ionomer resin, the golf ball showing excellent durability and travelling a long distance can be obtained. If the resin component constituting the cover contains the thermoplastic polyurethane resin (including a thermoplastic polyurethane elastomer), the golf ball showing excellent shot feeling and controllability can be obtained.

The resin component constituting the cover preferably contains a thermoplastic polyurethane resin. The content percentage of the thermoplastic polyurethane resin is preferably 50 mass % or more, more preferably 70 mass % or more, even more preferably 90 mass % or more.

The thermoplastic resin composition used in the present invention may further contain (C) an additive. Examples of (C) the additive include a pigment component such as a white pigment (for example, titanium oxide), a blue pigment or the like; a weight adjusting agent; a dispersant; an antioxidant; an ultraviolet absorber; a light stabilizer; a fluorescent material; a fluorescent brightener; or the like. Examples of the weight adjusting agent include inorganic fillers such as zinc oxide, barium sulfate, calcium carbonate, magnesium oxide, tungsten powder, molybdenum powder, and the like.

The content of the white pigment (for example, titanium oxide), with respect to 100 parts by mass of (A) the resin component, is preferably 0.5 part by mass or more, more preferably 1 part by mass or more, and is preferably 10 parts by mass or less, more preferably 8 parts by mass or less. If the content of the white pigment is 0.5 part by mass or more, it is possible to impart the opacity to the golf ball's constituent member. If the content of the white pigment is more than 10 parts by mass, the durability of the obtained golf ball's constituent member may deteriorate.

The thermoplastic resin composition used in the present invention can be obtained, for example, by dry blending (A) the resin component and (C) the additive. (B) The basic metal salt of the fatty acid is dry blended where necessary. Further, the dry blended mixture may be extruded into a pellet form. The d blending is preferably carried out by using for example, a mixer capable of blending raw materials in a pellet form, more preferably carried out by using a tumbler type mixer. Extruding can be carried out by using a publicly known extruder such as a single-screw extruder, a twin-screw extruder, and a twin-single extruder.

Rubber Composition

Next, the rubber composition which can be used in the present invention will be explained. Examples of the rubber composition include a composition containing a base rubber, a crosslinking initiator, a co-crosslinking agent, and a filler.

As the base rubber, a natural rubber and/or a synthetic rubber may be used. Examples of the base rubber include a polybutadiene rubber, a natural rubber, a polyisoprene rubber, a styrene polybutadiene rubber, and an ethylene-propylene-diene rubber (EPDM). These rubbers can be used solely or as a combination of two or more kinds. Among them, particularly preferred is a high cis-polybutadiene having cis-1,4-bond which is beneficial to resilience in a content of 40 mass % or more, more preferably 80 mass % or more, even more preferably 90 mass % or more.

The high cis-polybutadiene preferably has 1,2-vinyl bond in a content of 2 mass % or less, more preferably 1.7 mass % or less, and even more preferably 1.5 mass % or less. If the content of 1,2-vinyl bond is excessively high, the resilience may be lowered.

The high cis-polybutadiene preferably includes a product synthesized by using a rare-earth element catalyst. When a neodymium catalyst employing a neodymium compound which is a lanthanum series rare-earth element compound, is used, a polybutadiene rubber having a high content of cis-1,4 bond and a low content of 1,2-vinyl bond can be obtained with excellent polymerization activity, thus such a polybutadiene rubber is particularly preferred.

The high cis-polybutadiene preferably has a Mooney viscosity ($ML_{1+4}$ (100° C.)) of 30 or more, more preferably 32 or more, even more preferably 35 or more, and preferably has a Mooney viscosity ($ML_{1+4}$ (100° C.)) of 140 or less, more preferably 120 or less, even more preferably 100 or less, most preferably 80 or less. It is noted that the Mooney viscosity ($ML_{1+4}$ (100° C.)) in the present invention is a value measured according to JIS K6300 using an L rotor under the conditions of: a preheating time of 1 minute; a rotor rotation time of 4 minutes; and a temperature of 100° C.

The high cis-polybutadiene preferably has a molecular weight distribution Mw/Mn (Mw: weight average molecular weight, Mn: number average molecular weight) of 2.0 or more, more preferably 2.2 or more, even more preferably 2.4 or more, most preferably 2.6 or more, and preferably has a molecular weight distribution Mw/Mn of 6.0 or less, more preferably 5.0 or less, even more preferably 4.0 or less, most preferably 3.4 or less. If the molecular weight distribution (Mw/Mn) of the high cis-polybutadiene is excessively low, the processability may deteriorate. If the molecular weight distribution (Mw/Mn) of the high cis-polybutadiene is excessively high, the resilience may be lowered. It is noted that the molecular weight distribution is measured by gel permeation chromatography ("HLC-8120GPC" manufactured by Tosoh Corporation) using a differential refractometer as a detector under the conditions of column: GMH-HXL (manufactured by Tosoh Corporation), column temperature: 40° C., and mobile phase: tetrahydrofuran, and calculated by converting based on polystyrene standard.

The crosslinking initiator is blended to crosslink the base rubber component. As the crosslinking initiator, an organic peroxide is preferably used. Specific examples of the organic peroxide are dicumyl peroxide, 1,1-bis(t-butylperoxy)-3,3,5-trimethylcyclohexane, 2,5-dimethyl-2,5-di(t-butylperoxy) hexane, and di-t-butyl peroxide. Among them, dicumyl peroxide is preferably used. The blending amount of the crosslinking initiator is preferably 0.3 part by mass or more, more preferably 0.4 part by mass or more, and is preferably 5 parts by mass or less, more preferably 3 parts by mass or less, with respect to 100 parts by mass of the base rubber. If the amount is less than 0.3 part by mass, the resultant envelope layer becomes so soft that the resilience tends to be lowered, and if the amount is more than 5 parts by mass, the amount of the co-crosslinking agent must be decreased to obtain an appropriate hardness, which tends to cause the insufficient resilience.

The co-crosslinking agent is considered to have an action of crosslinking a rubber molecule by graft polymerization to a base rubber molecular chain. As the co-crosslinking agent, for example, an α,β-unsaturated carboxylic acid having 3 to 8 carbon atoms or a metal salt thereof can be used, examples thereof preferably include acrylic acid, methacrylic acid and a metal salt thereof. Examples of the metal constituting the metal salt include, for example, zinc, magnesium, calcium, aluminum and sodium, among them, zinc is preferably used because it provides high resilience.

The amount of the co-crosslinking agent to be used is preferably 10 parts by mass or more, more preferably, 15 parts by mass or more, even more preferably 20 parts by mass or more, and is preferably 55 parts by mass or less, more preferably 50 parts by mass or less, even more preferably 48 parts by mass or less, with respect to 100 parts by mass of the base rubber. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the resultant envelope layer becomes so hard that the shot feeling may be lowered.

The filler contained in the rubber composition is mainly blended as a weight adjusting agent in order to adjust the weight of the golf ball obtained as a final product, and may be blended where necessary. Examples of the filler include an inorganic filler such as zinc oxide, barium sulfate, calcium carbonate, magnesium oxide, tungsten powder, and molybdenum powder. The blending amount of the filler is preferably 0.5 part by mass or more, more preferably 1 part by mass or more, and is preferably 30 parts by mass or less, more preferably 20 parts by mass or less, with respect to 100 parts by mass of the base rubber. If the blending amount of the filler is less than 0.5 part by mass, it becomes difficult to adjust the weight, while if it is more than 30 parts by mass, the weight fraction of the rubber component becomes small and the resilience tends to be lowered.

An organic sulfur compound, an antioxidant, a peptizing agent or the like may be blended appropriately in the rubber composition, in addition to the base rubber, the crosslinking initiator, the co-crosslinking agent and the filler.

Examples of the organic sulfur compound include thiophenols, thionaphthols, polysulfides, thiocarboxylic acids, dithiocarboxylic acids, sulfenamindes, thiurams, dithiocarbamates, thiazoles, and the like. Among them, diphenyl disulfides may be preferably used as the organic sulfur compound, Examples of the diphenyl disulfides include diphenyl disulfide; a mono-substituted diphenyl disulfide such as bis(4-chlorophenyl)disulfide, bis(3-chlorophenyl) disulfide, bis(4-bromophenyl)disulfide, bis(3-bromophenyl) disulfide, bis(4-fluorophenyl)disulfide, bis(4-iodophenyl) disulfide, bis(4-cyanophenyl)disulfide; a di-substituted diphenyl disulfide such as bis/2,5-dichlorophenyl)disulfide, bis(3,5-dichlorophenyl)disulfide, bis(2,6-dichlorophenyl) disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide; a tri-substituted diphenyl disulfide such as bis(2,4,5-trichlorophenyl)disulfide, bis(2,4,6-trichlorophenyl)disulfide, bis(2-cyano-4-chloro-6-bromophenyl)disulfide; a tetra-substituted diphenyl disulfide such bis(2,3,5,6-tetra chlorophenyl)disulfide; a penta-substituted diphenyl disulfide such as bis(2,3,4,5,6-pentachlorophenyl)disulfide, bis(2,3,4,5,6-pentabromophenyl)disulfide. These diphenyl disulfides can enhance resilience by having some influence on the state of vulcanization of vulcanized rubber. Among them, diphenyl disulfide or bis(pentabromophenyl)disulfide is preferably used since the golf ball having particularly high resilience can be obtained. The blending amount of the organic sulfur compound is preferably 0.1 part by mass or more, more preferably 0.3 part by mass or more, and is preferably 5.0 parts by mass or less, more preferably 3.0 parts by mass or less, with respect to 100 parts by mass of the base rubber.

The blending amount of the antioxidant is preferably 0.1 part by mass or more and 1 part by mass or less with respect to 100 parts by mass of the base rubber. Further, the blending amount of the peptizing agent is preferably 0.1 part by mass or more and 5 parts by mass or less with respect to 100 parts by mass of the base rubber.

The raw materials are mixed and kneaded, and the resultant rubber composition is molded into the envelope layer in a mold. Examples of the method for molding the rubber composition into the envelope layer include, without particular limitation, a method comprising the steps of: molding the rubber composition into a half shell having a hemispherical shape beforehand, covering the golf ball body with two half shells, and compression molding at 130° C. to 170° C. for 5 minutes to 30 minutes; and a method of injection molding the rubber composition.

(4) Method for Producing Golf Ball

Center

The thermoplastic resin composition or the rubber composition can be used as the center constituent material. In the case that the center is formed from the thermoplastic resin composition, the center can be obtained, for example, by injection molding the thermoplastic resin composition. Specifically, it is preferred that the thermoplastic resin composition heated and melted at a temperature of 160° C. to 260° C. is charged into a mold held under a pressure of 1 MPa to 100 MPa for 1 second to 100 seconds, and after cooling for 30 second to 300 seconds, the mold is opened.

In the case that the center is formed from the rubber composition, the center can be obtained by molding the kneaded rubber composition in a mold. The temperature for molding the spherical center is preferably 120° C. to 170° C. The molding pressure is preferably 2.9 MPa to 11.8 MPa, and the molding time is preferably 10 minutes to 60 minutes.

Envelope Layer

The thermoplastic resin composition or the rubber composition can be used as the envelope layer constituent material. In the case that the envelope layer is formed from the thermoplastic resin composition, the envelope layer can be obtained, for example, by a method of molding the thermoplastic resin composition into a half shell having a hemispherical shape beforehand, covering the spherical body with two half shells, and compression molding at 130° C. to 170° C. for 1 minute to 5 minutes, or by a method of directly injection molding the thermoplastic resin composition onto the spherical body to cover the center therein.

When injection molding the thermoplastic resin composition onto the spherical body to mold the envelope layer, it is preferred to use upper and lower molds having a hemispherical cavity and a hold pin. Injection molding of the envelope layer can be carried out by protruding the hold pin to hold the spherical body, charging the heated and melted thermoplastic resin composition and then cooling to obtain the envelope layer.

When molding the envelope layer by compression molding method, the half shell can be molded by either compression molding method or injection molding method, but compression molding method is preferred. Compression molding the thermoplastic resin composition into the half shell can be carried out, for example, under a pressure of 1 MPa or more and 20 MPa or less at a molding temperature of −20° C. or more and 70° C. or less relative to the flow beginning temperature of the thermoplastic resin composition. By carrying out the molding under the above conditions, the half shell with a uniform thickness can be formed. Examples of the method for molding the envelope layer with half shells include a method of covering the spherical body with two half shells and then performing compression molding, Compression molding the half shells into the envelope layer can be carried out, for example, under a molding pressure of 0.5 MPa or more and 25 MPa or less at a molding temperature of −20° C. or more and 70° C. or less relative to the flow beginning temperature of the thermoplastic resin composition. By carrying out the molding under the above conditions, the envelope layer with a uniform thickness can be formed.

The molding temperature means the highest temperature where the temperature at the surface of the concave portion of the lower mold reaches from closing the mold to opening the mold. Further, the flow beginning temperature of the thermoplastic resin composition can be measured in a pellet form under the following conditions by using "Flow Tester CFT500" manufactured by Shimadzu Corporation.

Measuring conditions: Plunger Area: 1 $cm^2$, Die length: 1 mm, Die diameter: 1 mm, Load: 588.399 N, Start temperature: 30° C., and Temperature increase rate: 3° C./min.

When the envelope layer is formed from the rubber composition, the envelope layer can be obtained, for example, by a method of molding the rubber composition into a half shell having a hemispherical shape beforehand, covering the spherical body with two half shells, and compression molding at 130° C. to 170° C. for 5 minutes to 30 minutes. The envelope layer may also be formed by injection molding the rubber composition.

Cover

The thermoplastic resin composition can be used as the cover constituent material. As the method of molding the thermoplastic resin composition into the cover, the above-described method of molding the thermoplastic resin composition into the envelope layer can be adopted. It is preferred to use upper and lower molds having a hemispherical cavity and pimples wherein a part of the pimple also serves as a retractable hold pin.

The concave portions called "dimple" are usually formed on the surface of the cover. The total number of dimples formed on the cover is preferably 200 or more and 500 or less. If the total number of dimples is less than 200, the dimple effect is hardly obtained. On the other hand, if the total number of dimples exceeds 500, the dimple effect is hardly obtained because the size of the respective dimple is small. The shape (shape in a plan view) of dimples includes, without limitation, a circle; a polygonal shape such as a roughly triangular shape, a roughly quadrangular shape, a roughly pentagonal shape, a roughly hexagonal shape; or other irregular shape. The shape of dimples is employed solely or in combination of at least two of them.

After the cover is molded, the obtained golf ball body is ejected from the mold, and is preferably subjected to surface treatments such as deburring, cleaning and sandblast where necessary. If desired, a paint film or a mark may be formed. The paint film preferably has a thickness of, but not limited to, 5 μm or larger, and more preferably 7 μm or larger, and preferably has a thickness of 50 μm or smaller, more preferably 40 μm or smaller, even more preferably 30 μm or smaller. If the thickness of the paint film is smaller than 5 μm, the paint film is easy to wear off due to continued use of the golf ball, and if the thickness of the paint film is larger than 50 μm, the dimple effect is reduced, resulting in lowering flying performance of the golf ball.

Examples

Hereinafter, the present invention will be described in detail by way of example. The present invention is not limited to examples described below. Various changes and modifications can be made without departing from the spirit and scope of the present invention.

[Evaluation Method]

Material Hardness (Shore D Hardness)

In case of the thermoplastic resin composition, sheets with a thickness of about 2 mm were produced by injection molding, and in case of the rubber composition, sheets with a thickness of about 2 mm were produced by compressing at 170° C. for 25 minutes. These sheets were stored at 23° C. for two weeks. Three or more of these sheets were stacked on one another so as not to be affected by the measuring substrate on which the sheets were placed, and the hardness of the stack was measured with a type P1 auto loading durometer manufactured by Kobunshi Keiki Co., Ltd., provided with a Shore D type spring hardness tester prescribed in ASTM-D2240.

Center Hardness Ho2 of Golf Ball (Shore D Hardness)

The golf ball was cut into two hemispheres to obtain a cut plane, and the cross-sectional hardness (Ho) at the center of the cut plane was measured. A type P1 auto loading durometer manufactured by Kobunshi Keiki Co., Ltd., provided with a Shore D type spring hardness tester prescribed in ASTM-D2240 standard was used for the measurement.

Tensile Elastic Modulus (MPa)

In the case of a thermoplastic resin composition, a sheet with a thickness of about 2 mm was prepared by injection molding. In the case of a rubber composition, a sheet with a thickness of about 2 mm was prepared by pressing at 170° C. for 25 minutes. The obtained sheets were stored at 23 CC for two weeks. Then, a test piece with a dumbbell shape was prepared from the sheet, and the tensile elastic modulus of the test piece was measured according to ISO 527-1.

Compression Deformation Amount (mm)

The compression deformation amount of the golf ball along the compression direction (shrinking amount of the golf ball along the compression direction), when applying a load from 98 N as an initial load to 1275 N as a final load to the golf ball, was measured.

Spin Rate (rpm) on Driver Shots

A metal-headed W#1 driver (XXIO S, loft: 11°, manufactured by Dunlop Sports Limited) was installed on a swing robot M/C manufactured by Golf Laboratories, Inc. The golf ball was hit at a head speed of 50 m/sec, and the spin rate right after hitting the golf ball was measured. This measurement was conducted twelve times for each golf ball, and the average value thereof was adopted as the measurement value for the golf ball, A sequence of photographs of the hit golf ball were taken for measuring the spin rate right after hitting the golf ball.

Spin Rate on Approach Shots

A sand wedge (CG15 forged wedge (58°), manufactured by Cleveland Golf) was installed on a swing machine manufactured by True Temper Sports, Inc. The golf ball was hit at a head speed of 10 m/sec, and the spin rate (rpm) was measured by taking a sequence of photographs of the hit golf ball. This measurement was conducted ten times for each golf ball, and the average value thereof was adopted as the spin rate.

[Preparation of Thermoplastic Resin Composition]

As shown in Table 1, the blending materials were dry blended, followed by mixing with a twin-screw kneading extruder to extrude the blended material in a strand form into the cool water. The extruded strand was cut with a pelletizer to prepare the thermoplastic resin composition in a pellet form. Extrusion was performed in the following conditions: screw diameter: 45 mm, screw revolutions: 200 rpm; and screw L/D=35. The blending materials were heated to a temperature in a range from 160° C. to 230° C. at the die position of the extruder.

TABLE 1

| Thermoplastic resin composition No. | | a | b | c | d | e | f | g | h | i | k | l |
|---|---|---|---|---|---|---|---|---|---|---|---|---|
| Formulation (parts by mass) | Himilan AM7327 | — | — | 50 | — | — | — | — | — | — | — | — |
| | Nucrel AN4319 | — | — | — | 40 | — | — | — | — | — | — | — |
| | Himilan 1605 | — | — | — | — | — | — | — | — | — | 50 | — |
| | Himilan AM7329 | — | — | — | — | — | — | — | — | — | 50 | — |
| | HPF2000 | 100 | — | — | — | 75 | 60 | 50 | 25 | — | — | — |
| | HPF1000 | — | 100 | — | — | — | — | — | — | — | — | — |
| | Rabalon T3221C | — | — | 50 | 60 | 25 | 40 | 50 | 75 | 100 | — | — |
| | Elastollan XNY84A | — | — | — | — | — | — | — | — | — | — | 100 |
| | Basic Mg oleate | — | — | 15 | 28 | — | — | — | — | — | — | — |
| | Titanium oxide | — | — | — | — | — | — | — | — | — | 4 | 4 |
| Tensile elastic modulus (MPa) | | 58.8 | 114.1 | 16.8 | 13.0 | 28.4 | 19.5 | 15.1 | 7.4 | 3.7 | 226.2 | 19.0 |
| Shore D hardness | | 45 | 54 | 27 | 23 | 35 | 29 | 25 | 15 | 5 | 65 | 32 |
| Ionomer resin/Styrene-based elastomer | | — | — | 1.0 | 0.7 | 3.0 | 1.5 | 1.0 | 0.3 | — | — | — |

The materials used in Table 1 are follows.

Himilan AM7327: zinc ion-neutralized ethylene-methacrylic acid-butyl acrylate ternary copolymer ionomer resin (melt flow rate (190° C., 2.16 kgf): 0.7 g/10 min, bending stiffness: 35 MPa) manufactured by Mitsui-Du Pont Polychemicals Co., Ltd.

Nucrel AN4319: ethylene-methacrylic acid-butyl acrylate copolymer (melt flow rate (190° C., 2.16 kgf): 55 g/10 min, bending stiffness: 21 MPa) manufactured by Mitsui-Du Pont Polychemicals Co., Ltd.

Himilan 1605: sodium ion-neutralized ethylene-methacrylic acid copolymer ionomer resin (melt flow rate (190° C., 2.16 kgf): 2.8 g/10 min, bending stiffness: 320 MPa) manufactured by Mitsui-Du Pont Polychemicals Co., Ltd.

Himilan AM7329: zinc ion-neutralized ethylene-methacrylic acid copolymer ionomer resin (melt flow rate (190° C., 2.16 kgf): 5 g/10 min, bending stiffness: 221 MPa) manufactured by Mitsui-Du Pont Polychemicals Co., Ltd.

HPF2000: magnesium ion-neutralized ternary copolymer ionomer resin (melt flow rate (190° C., 2.16 kgf): 1.0 g/10 min, bending stiffness: 64 MPa) manufactured by E. I. du Pont de Nemours and Company HPF1000: magnesium ion-neutralized ternary copolymer ionomer resin (melt flow rate (190° C., 2.16 kgf): 0.7 g/10 min, bending stiffness: 190 MPa) manufactured by E. I. du Pont de Nemours and Company Rabalon T3221C: thermoplastic styrene elastomer (alloy of one kind or two or more kinds selected from the group consisting of SBS, SIS, SIBS, SEBS, SEPS, SEEPS and a hydrogenated product thereof with a polyolefin) manufactured by Mitsubishi Chemical Corporation Elastollan XNY84A: thermoplastic polyurethane elastomer manufactured by BASF Japan Ltd.

Basic Mg oleate: (metal content: 1.7 mole %; in the formula (1), $M^1 = M^2 = Mg$, R = 17 carbon atoms) manufactured by Nitto kasei Kougyo Co., Ltd.

Titanium oxide: A220 manufactured by Ishihara Sangyo Co., Ltd.

[Preparation of Rubber Composition]

The materials shown in Table 2 were mixed and kneaded to prepare the rubber composition.

TABLE 2

| Rubber composition No. | | A | B | C | D | E |
|---|---|---|---|---|---|---|
| Formulation (parts by mass) | Polybutadiene rubber | 100 | 100 | 100 | 100 | 100 |
| | Zinc acrylate | 18 | 37 | 10 | 5 | 20 |
| | Zinc oxide | 5 | 5 | 5 | 5 | 5 |
| | Diphenyl disulfide | 0.5 | — | 0.5 | 0.5 | 0.5 |
| | Bis(pentabromophenyl) disulfide | — | 0.3 | — | — | — |
| | Dicumyl peroxide | 0.7 | 0.9 | 0.7 | 0.7 | 0.7 |
| | Barium sulfate | Appropriate amount | Appropriate amount | Appropriate amount | Appropriate amount | Appropriate amount |

TABLE 2-continued

| Rubber composition No. | A | B | C | D | E |
|---|---|---|---|---|---|
| Tensile elastic modulus (MPa) | 16.3 | 126.2 | 9.2 | 4.5 | 42.5 |
| Shore D hardness | 34 | 51 | 27 | 19 | 45 |

The materials used in Table 2 are follows.

Polybutadiene rubber: "BR-730 (high-cis polybutadiene, cis-1,4 bond content = 96 mass %, 1,2-vinyl bond content = 1.3 mass %, Moony viscosity ($ML_{1+4}$ (100° C.) = 55, molecular weight distribution (Mw/Mn) = 3)" manufactured by JSR Corporation Zinc acrylate: "ZNDA-90S" manufactured by Nihon Jyoryu Kogyo Co., Ltd.

Zinc oxide: "Ginrei (registered trademark) R" manufactured by Toho Zinc Co., Ltd.

Diphenyl disulfide: manufactured by Sumitomo Seika Chemicals Co., Ltd.

Dicumyl peroxide: "Percumyl (registered trademark) D" manufactured by NOF Corporation Barium sulfate: "Barium Sulfate BD" manufactured by Sakai Chemical Industry Co., Ltd.

[Production of Golf Ball]

(i) Spherical Center

Center Formed from Thermoplastic Resin Composition

The thermoplastic resin composition in a pellet form was injection molded at 200° C. to produce the spherical center.

Center Formed from Rubber Composition

The rubber composition was heat-pressed at 170° C. for 20 minutes in upper and lower molds having a hemispherical cavity to produce the spherical center.

(ii) Envelope Layer

Envelope Layer Formed from Thermoplastic Resin Composition

The thermoplastic resin composition in a pellet form was injection molded at 200° C. to mold the envelope layer. It is noted that each envelope layer was molded one by one. The utilized upper and lower molds have a hemispherical cavity and a retractable hold pin for holding the spherical body. Molding of the envelope layer was carried out by protruding the hold pin to hold the spherical body, charging the thermoplastic resin composition into the molds, cooling and then opening the molds to eject the spherical body.

Envelope Layer Formed from Rubber Composition

The rubber composition was molded into half shells, and the spherical body was covered with two half shells. The spherical body and the half shells were charged together into the mold consisting of upper and lower molds which have a hemispherical cavity, and then heated at 170° C. for 25 minutes to produce the envelope layer from the rubber composition.

(iii) Cover

The cover was formed by compression molding the obtained thermoplastic resin composition. Thermoplastic resin composition in a pellet form was charged into each concave portion of the lower mold of the mold which is used for molding the half shell, and compression was performed to form the half shell. Compression molding was conducted at the molding temperature of 160° C., the molding time of 2 minutes, and the molding pressure of 11 MPa. The spherical body on which the envelope layers have been formed was concentrically covered with two half shells, then charged into the mold having a plurality of pimples on one surface of the Cavity thereof, and compression molded to form the cover. Compression molding was conducted at the molding temperature of 150° C., the molding time of 3 minutes and the molding pressure of 13 MPa. A plurality of dimples having a reversed shape of the pimple shape were formed on the molded cover.

(iv) Paint

The surface of the obtained golf ball body was treated with sandblast, marked, and painted with a clear paint. The paint was dried in an oven at 40° C. to obtain the golf ball. The thickness and material hardness of each layer, and the evaluation results of the golf ball were shown in Tables 3 to 6.

TABLE 3

| | Golf ball No. | 1-1 | 1-2 | 1-3 | 1-4 | 1-5 | 1-6 | 1-7 | 1-8 |
|---|---|---|---|---|---|---|---|---|---|
| Center | Material No. | e | e | e | a | c | e | f | f |
| | Hardness Ho1 (Shore D) | 35 | 35 | 35 | 45 | 27 | 35 | 29 | 29 |
| | Hardness Ho2 (Shore D) | 35 | 35 | 35 | 45 | 27 | 35 | 29 | 29 |
| | Tensile elastic modulus (MPa) | 28.4 | 28.4 | 28.4 | 58.8 | 16.8 | 28.4 | 19.5 | 19.5 |
| | Diameter (mm) | 15 | 15 | 15 | 15 | 15 | 15 | 15 | 20 |
| | Radius cumulation (%) | 35.0 | 35.0 | 35.0 | 35.0 | 35.0 | 35.0 | 35.0 | 46.7 |
| First envelope layer | Material No. | f | f | g | f | g | f | a | a |
| | Hardness (Shore D) | 29 | 29 | 25 | 29 | 25 | 29 | 45 | 45 |
| | Tensile elastic modulus (MPa) | 19.5 | 19.5 | 15.1 | 19.5 | 15.1 | 19.5 | 58.8 | 58.8 |
| | Thickness (mm) | 2.5 | 2.5 | 2.5 | 2.5 | 2.5 | 2.5 | 2.5 | 2.5 |
| | Radius cumulation (%) | 46.7 | 46.7 | 46.7 | 46.7 | 46.7 | 46.7 | 46.7 | 58.4 |
| Second envelope layer | Material No. | h | h | h | h | h | h | g | d |
| | Hardness (Shore D) | 15 | 15 | 15 | 15 | 15 | 15 | 25 | 23 |
| | Tensile elastic modulus (MPa) | 7.4 | 7.4 | 7.4 | 7.4 | 7.4 | 7.4 | 15.1 | 13.0 |
| | Thickness (mm) | 2.5 | 2.5 | 2.5 | 2.5 | 2.5 | 2.5 | 2.5 | 2.5 |
| | Radius cumulation (%) | 58.4 | 58.4 | 58.4 | 58.4 | 58.4 | 58.4 | 58.4 | 70.1 |
| Third envelope layer | Material No. | a | a | a | a | a | a | a | a |
| | Hardness (Shore D) | 45 | 45 | 45 | 45 | 45 | 45 | 45 | 45 |
| | Tensile elastic modulus (MPa) | 58.8 | 58.8 | 58.8 | 58.8 | 58.8 | 58.8 | 58.8 | 58.8 |
| | Thickness (mm) | 2.5 | 5.0 | 2.5 | 2.5 | 2.5 | 5.0 | 5.0 | 2.5 |
| | Radius cumulation (%) | 70.1 | 81.8 | 70.1 | 70.1 | 70.1 | 81.8 | 81.8 | 81.8 |

TABLE 3-continued

| | Golf ball No. | 1-1 | 1-2 | 1-3 | 1-4 | 1-5 | 1-6 | 1-7 | 1-8 |
|---|---|---|---|---|---|---|---|---|---|
| Fourth envelope layer | Material No. | b | b | b | b | b | b | b | b |
| | Hardness (Shore D) | 54 | 54 | 54 | 54 | 54 | 54 | 54 | 54 |
| | Tensile elastic modulus (MPa) | 114.1 | 114.1 | 114.1 | 114.1 | 114.1 | 114.1 | 114.1 | 114.1 |
| | Thickness (mm) | 4.9 | 2.4 | 4.9 | 4.9 | 4.9 | 2.4 | 2.4 | 2.4 |
| | Radius cumulation (%) | 93.0 | 93.0 | 93.0 | 93.0 | 93.0 | 93.0 | 93.0 | 93.0 |
| Fifth envelope layer | Material No. | k | k | k | k | k | k | k | k |
| | Hardness (Shore D) | 65 | 65 | 65 | 65 | 65 | 65 | 65 | 65 |
| | Tensile elastic modulus (MPa) | 226.2 | 226.2 | 226.2 | 226.2 | 226.2 | 226.2 | 226.2 | 226.2 |
| | Thickness (mm) | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 |
| Cover | Material No. | l | l | l | l | l | l | l | l |
| | Hardness Hc (Shore D) | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 |
| Hardness difference (Ho − Hs) | | 20 | 20 | 20 | 30 | 12 | 20 | 4 | 6 |
| Hardness difference (Hh − Hs) | | 50 | 50 | 50 | 50 | 50 | 50 | 40 | 42 |
| Hardness difference (Hh − Ho) | | 30 | 30 | 30 | 20 | 38 | 30 | 36 | 36 |
| Physical properties | Compression deformation amount (mm) | 2.72 | 2.80 | 2.73 | 2.70 | 2.75 | 2.82 | 2.80 | 2.83 |
| | Driver spin rate Sd (rpm) | 2371 | 2367 | 2316 | 2445 | 2246 | 2312 | 2582 | 2428 |
| | Approach spin rate Sa10 (rpm) | 3799 | 3749 | 3802 | 3801 | 3801 | 3751 | 3712 | 3512 |
| | Sd/Sa10 | 0.62 | 0.63 | 0.61 | 0.64 | 0.59 | 0.62 | 0.70 | 0.69 |

TABLE 4

| | Golf ball No. | 1-9 | 1-10 | 1-11 | 1-12 | 1-13 | 1-14 | 1-15 | 1-16 |
|---|---|---|---|---|---|---|---|---|---|
| Center | Material No. | f | f | c | g | f | f | a | f |
| | Hardness Ho1 (Shore D) | 29 | 29 | 27 | 25 | 29 | 29 | 45 | 29 |
| | Hardness Ho2 (Shore D) | 29 | 29 | 27 | 25 | 29 | 29 | 45 | 29 |
| | Tensile elastic modulus (MPa) | 19.5 | 19.5 | 16.8 | 15.1 | 19.5 | 19.5 | 58.8 | 19.5 |
| | Diameter (mm) | 15 | 20 | 15 | 15 | 20 | 15 | 15 | 15 |
| | Radius cumulation (%) | 35.0 | 46.7 | 35.0 | 35.0 | 46.7 | 35.0 | 35.0 | 35.0 |
| First envelope layer | Material No. | a | a | a | a | a | a | g | g |
| | Hardness (Shore D) | 45 | 45 | 45 | 45 | 45 | 45 | 25 | 25 |
| | Tensile elastic modulus (MPa) | 58.8 | 58.8 | 58.8 | 58.8 | 58.8 | 58.8 | 15.1 | 15.1 |
| | Thickness (mm) | 2.5 | 2.5 | 2.5 | 2.5 | 5.0 | 2.5 | 2.5 | 2.5 |
| | Radius cumulation (%) | 46.7 | 58.4 | 46.7 | 46.7 | 70.1 | 46.7 | 46.7 | 46.7 |
| Second envelope layer | Material No. | h | h | i | h | g | a | a | a |
| | Hardness (Shore D) | 15 | 15 | 5 | 15 | 25 | 45 | 45 | 45 |
| | Tensile elastic modulus (MPa) | 7.4 | 7.4 | 3.7 | 7.4 | 15.1 | 58.8 | 58.8 | 58.8 |
| | Thickness (mm) | 2.5 | 2.5 | 2.5 | 2.5 | 2.5 | 7.5 | 7.5 | 7.5 |
| | Radius cumulation (%) | 58.4 | 70.1 | 58.4 | 58.4 | 81.8 | 81.8 | 81.8 | 81.8 |
| Third envelope layer | Material No. | a | a | a | a | — | — | — | — |
| | Hardness (Shore D) | 45 | 45 | 45 | 45 | — | — | — | — |
| | Tensile elastic modulus (MPa) | 58.8 | 58.8 | 58.8 | 58.8 | — | — | — | — |
| | Thickness (mm) | 5.0 | 2.5 | 5.0 | 5.0 | — | — | — | — |
| | Radius cumulation (%) | 81.8 | 81.8 | 81.8 | 81.8 | — | — | — | — |
| Fourth envelope layer | Material No. | b | b | b | b | b | b | b | g |
| | Hardness (Shore D) | 54 | 54 | 54 | 54 | 54 | 54 | 54 | 25 |
| | Tensile elastic modulus (MPa) | 114.1 | 114.1 | 114.1 | 114.1 | 114.1 | 114.1 | 114.1 | 15.1 |
| | Thickness (mm) | 2.4 | 2.4 | 2.4 | 2.4 | 2.4 | 2.4 | 2.4 | 2.4 |
| | Radius cumulation (%) | 93.0 | 93.0 | 93.0 | 93.0 | 93.0 | 93.0 | 93.0 | 93.0 |
| Fifth envelope layer | Material No. | k | k | k | k | k | k | k | k |
| | Hardness (Shore D) | 65 | 65 | 65 | 65 | 65 | 65 | 65 | 65 |
| | Tensile elastic modulus (MPa) | 226.2 | 226.2 | 226.2 | 226.2 | 226.2 | 226.2 | 226.2 | 226.2 |
| | Thickness (mm) | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 |
| Cover | Material No. | l | l | l | l | l | l | l | l |
| | Hardness Hc (Shore D) | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 |

TABLE 4-continued

| | Golf ball No. | 1-9 | 1-10 | 1-11 | 1-12 | 1-13 | 1-14 | 1-15 | 1-16 |
|---|---|---|---|---|---|---|---|---|---|
| Hardness difference (Ho − Hs) | | 14 | 14 | 22 | 10 | 4 | — | 20 | 4 |
| Hardness difference (Hh − Hs) | | 50 | 50 | 60 | 50 | 40 | 36 | 40 | 40 |
| Hardness difference (Hh − Ho) | | 36 | 36 | 38 | 40 | 36 | 36 | 20 | 36 |
| Physical properties | Compression deformation amount (mm) | 2.86 | 2.90 | 2.79 | 2.84 | 2.82 | 2.64 | 2.45 | 2.95 |
| | Driver spin rate Sd (rpm) | 2478 | 2382 | 2389 | 2469 | 2573 | 2755 | 2708 | 2573 |
| | Approach spin rate Sa10 (rpm) | 3739 | 3465 | 3701 | 3739 | 3523 | 3667 | 3678 | 3675 |
| | Sd/Sa10 | 0.66 | 0.69 | 0.65 | 0.66 | 0.73 | 0.75 | 0.74 | 0.70 |

TABLE 5

| | Golf ball No. | 2-1 | 2-2 | 2-3 | 2-4 | 2-5 | 2-6 | 2-7 |
|---|---|---|---|---|---|---|---|---|
| Center | Material No. | A | A | A | E | A | A | A |
| | Hardness Ho1 (Shore D) | 34 | 34 | 34 | 45 | 34 | 34 | 34 |
| | Hardness Ho2 (Shore D) | 34 | 34 | 34 | 45 | 34 | 34 | 34 |
| | Tensile elastic modulus (MPa) | 16.3 | 16.3 | 16.3 | 42.5 | 16.3 | 16.3 | 16.3 |
| | Diameter (mm) | 15 | 15 | 15 | 15 | 15 | 15 | 15 |
| | Radius cumulation (%) | 35.0 | 35.0 | 35.0 | 35.0 | 35.0 | 35.0 | 35.0 |
| First envelope layer | Material No. | f | f | g | g | f | a | a |
| | Hardness (Shore D) | 29 | 29 | 25 | 25 | 29 | 45 | 45 |
| | Tensile elastic modulus (MPa) | 19.5 | 19.5 | 15.1 | 15.1 | 19.5 | 58.8 | 58.8 |
| | Thickness (mm) | 2.5 | 2.5 | 2.5 | 2.5 | 2.5 | 2.5 | 2.5 |
| | Radius cumulation (%) | 46.7 | 46.7 | 46.7 | 46.7 | 46.7 | 46.7 | 46.7 |
| Second envelope layer | Material No. | C | C | D | D | C | C | D |
| | Hardness (Shore D) | 27 | 27 | 19 | 19 | 27 | 27 | 19 |
| | Tensile elastic modulus (MPa) | 9.2 | 9.2 | 4.5 | 4.5 | 9.2 | 9.2 | 4.5 |
| | Thickness (mm) | 2.5 | 2.5 | 2.5 | 2.5 | 2.5 | 2.5 | 2.5 |
| | Radius cumulation (%) | 58.4 | 58.4 | 58.4 | 58.4 | 58.4 | 58.4 | 58.4 |
| Third envelope layer | Material No. | a | a | a | a | a | a | a |
| | Hardness (Shore D) | 45 | 45 | 45 | 45 | 45 | 45 | 45 |
| | Tensile elastic modulus (MPa) | 58.8 | 58.8 | 58.8 | 58.8 | 58.8 | 58.8 | 58.8 |
| | Thickness (mm) | 2.5 | 5.0 | 2.5 | 5.0 | 5.0 | 5.0 | 5.0 |
| | Radius cumulation (%) | 70.1 | 81.8 | 70.1 | 81.8 | 81.8 | 81.8 | 81.8 |
| Fourth envelope layer | Material No. | b | b | b | b | b | b | b |
| | Hardness (Shore D) | 54 | 54 | 54 | 54 | 54 | 54 | 54 |
| | Tensile elastic modulus (MPa) | 114.1 | 114.1 | 114.1 | 114.1 | 114.1 | 114.1 | 114.1 |
| | Thickness (mm) | 4.9 | 2.4 | 4.9 | 2.4 | 2.4 | 2.4 | 2.4 |
| | Radius cumulation (%) | 93.0 | 93.0 | 93.0 | 93.0 | 93.0 | 93.0 | 93.0 |
| Fifth envelope layer | Material No. | k | k | k | k | k | k | k |
| | Hardness (Shore D) | 65 | 65 | 65 | 65 | 65 | 65 | 65 |
| | Tensile elastic modulus (MPa) | 226.2 | 226.2 | 226.2 | 226.2 | 226.2 | 226.2 | 226.2 |
| | Thickness (mm) | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 |
| Cover | Material No. | 1 | 1 | 1 | 1 | 1 | 1 | 1 |
| | Hardness Hc (Shore D) | 32 | 32 | 32 | 32 | 32 | 32 | 32 |
| | Thickness (mm) | 0.5 | 0.5 | 0.5 | 0.5 | 0.5 | 0.5 | 0.5 |
| Hardness difference (Ho − Hs) | | 7 | 7 | 15 | 26 | 7 | 7 | 15 |
| Hardness difference (Hh − Hs) | | 38 | 38 | 46 | 46 | 38 | 38 | 46 |
| Hardness difference (Hh − Ho) | | 31 | 31 | 31 | 31 | 31 | 31 | 31 |
| Physical properties | Compression deformation amount (mm) | 2.71 | 2.80 | 2.73 | 2.71 | 2.81 | 2.76 | 2.79 |
| | Driver spin rate Sd (rpm) | 2377 | 2373 | 2322 | 2357 | 2318 | 2545 | 2503 |
| | Approach spin rate Sa10 (rpm) | 3797 | 3746 | 3799 | 3800 | 3749 | 3738 | 3749 |
| | Sd/Sa10 | 0.63 | 0.63 | 0.61 | 0.62 | 0.62 | 0.68 | 0.67 |

TABLE 6

| | Golf ball No. | 2-8 | 2-9 | 2-10 | 2-11 |
|---|---|---|---|---|---|
| Center | Material No. | A | A | A | A |
| | Hardness Ho1 (Shore D) | 34 | 34 | 34 | 34 |
| | Hardness Ho2 (Shore D) | 34 | 34 | 34 | 34 |

TABLE 6-continued

| | Golf ball No. | 2-8 | 2-9 | 2-10 | 2-11 |
|---|---|---|---|---|---|
| | Tensile elastic modulus (MPa) | 16.3 | 16.3 | 16.3 | 16.3 |
| | Diameter (mm) | 20 | 15 | 15 | 15 |
| | Radius cumulation (%) | 46.7 | 35.0 | 35.0 | 35.0 |
| First envelope layer | Material No. | a | a | g | g |
| | Hardness (Shore D) | 45 | 45 | 25 | 25 |
| | Tensile elastic modulus (MPa) | 58.8 | 58.8 | 15.1 | 15.1 |
| | Thickness (mm) | 5.0 | 2.5 | 2.5 | 2.5 |
| | Radius cumulation (%) | 70.1 | 46.7 | 46.7 | 46.7 |
| Second envelope layer | Material No. | C | E | E | E |
| | Hardness (Shore D) | 27 | 45 | 45 | 45 |
| | Tensile elastic modulus (MPa) | 9.2 | 42.5 | 42.5 | 42.5 |
| | Thickness (mm) | 2.5 | 7.5 | 7.5 | 7.5 |
| | Radius cumulation (%) | 81.8 | 81.8 | 81.8 | 81.8 |
| Third envelope layer | Material No. | — | — | — | — |
| | Hardness (Shore D) | — | — | — | — |
| | Tensile elastic modulus (MPa) | — | — | — | — |
| | Thickness (mm) | — | — | — | — |
| | Radius cumulation (%) | — | — | — | — |
| Fourth envelope layer | Material No. | b | b | b | g |
| | Hardness (Shore D) | 54 | 54 | 54 | 25 |
| | Tensile elastic modulus (MPa) | 114.1 | 114.1 | 114.1 | 15.1 |
| | Thickness (mm) | 2.4 | 2.4 | 2.4 | 2.4 |
| | Radius cumulation (%) | 93.0 | 93.0 | 93.0 | 93.0 |
| Fifth envelope layer | Material No. | k | k | k | k |
| | Hardness (Shore D) | 65 | 65 | 65 | 65 |
| | Tensile elastic modulus (MPa) | 226.2 | 226.2 | 226.2 | 226.2 |
| | Thickness (mm) | 1.0 | 1.0 | 1.0 | 1.0 |
| | Radius cumulation (%) | 97.7 | 97.7 | 97.7 | 97.7 |
| Cover | Material No. | l | l | l | l |
| | Hardness Hc (Shore D) | 32 | 32 | 32 | 32 |
| | Thickness (mm) | 0.5 | 0.5 | 0.5 | 0.5 |
| Hardness difference (Ho − Hs) | | 7 | 2 | 9 | 9 |
| Hardness difference (Hh − Hs) | | 38 | 31 | 40 | 40 |
| Hardness difference (Hh − Ho) | | 31 | 31 | 31 | 31 |
| Physical properties | Compression deformation amount (mm) | 3.04 | 2.76 | 2.78 | 2.81 |
| | Driver spin rate Sd (rpm) | 2695 | 2718 | 2536 | 2536 |
| | Approach spin rate Sa10 (rpm) | 3438 | 3596 | 3604 | 3604 |
| | Sd/Sa10 | 0.78 | 0.76 | 0.70 | 0.70 |

TABLE 7

| | Golf ball No. | 3-1 | 3-2 | 3-3 | 3-4 | 3-5 | 3-6 | 3-7 |
|---|---|---|---|---|---|---|---|---|
| Center | Material No. | e | e | e | a | e | f | f |
| | Hardness Ho1 (Shore D) | 35 | 35 | 35 | 45 | 35 | 29 | 29 |
| | Hardness Ho2 (Shore D) | 35 | 35 | 35 | 45 | 35 | 29 | 29 |
| | Tensile elastic modulus (MPa) | 28.4 | 28.4 | 28.4 | 58.8 | 28.4 | 19.5 | 19.5 |
| | Diameter (mm) | 15 | 15 | 15 | 15 | 15 | 15 | 15 |
| | Radius cumulation (%) | 35.0 | 35.0 | 35.0 | 35.0 | 35.0 | 35.0 | 35.0 |
| First envelope layer | Material No. | f | f | g | g | f | a | a |
| | Hardness (Shore D) | 29 | 29 | 25 | 25 | 29 | 45 | 45 |
| | Tensile elastic modulus (MPa) | 19.5 | 19.5 | 15.1 | 15.1 | 19.5 | 58.8 | 58.8 |
| | Thickness (mm) | 2.5 | 2.5 | 2.5 | 2.5 | 2.5 | 2.5 | 2.5 |
| | Radius cumulation (%) | 46.7 | 46.7 | 46.7 | 46.7 | 46.7 | 46.7 | 46.7 |
| Second envelope layer | Material No. | C | C | D | D | C | C | D |
| | Hardness (Shore D) | 27 | 27 | 19 | 19 | 27 | 27 | 19 |
| | Tensile elastic modulus (MPa) | 9.2 | 9.2 | 4.5 | 4.5 | 9.2 | 9.2 | 4.5 |
| | Thickness (mm) | 2.5 | 2.5 | 2.5 | 2.5 | 2.5 | 2.5 | 2.5 |
| | Radius cumulation (%) | 58.4 | 58.4 | 58.4 | 58.4 | 58.4 | 58.4 | 58.4 |

TABLE 7-continued

| | Golf ball No. | 3-1 | 3-2 | 3-3 | 3-4 | 3-5 | 3-6 | 3-7 |
|---|---|---|---|---|---|---|---|---|
| Third envelope layer | Material No. | a | a | a | a | a | a | a |
| | Hardness (Shore D) | 45 | 45 | 45 | 45 | 45 | 45 | 45 |
| | Tensile elastic modulus (MPa) | 58.8 | 58.8 | 58.8 | 58.8 | 58.8 | 58.8 | 58.8 |
| | Thickness (mm) | 2.5 | 5.0 | 2.5 | 5.0 | 5.0 | 5.0 | 5.0 |
| | Radius cumulation (%) | 70.1 | 81.8 | 70.1 | 81.8 | 81.8 | 81.8 | 81.8 |
| Fourth envelope layer | Material No. | b | b | b | b | b | b | b |
| | Hardness (Shore D) | 54 | 54 | 54 | 54 | 54 | 54 | 54 |
| | Tensile elastic modulus (MPa) | 114.1 | 114.1 | 114.1 | 114.1 | 114.1 | 114.1 | 114.1 |
| | Thickness (mm) | 4.9 | 2.4 | 4.9 | 2.4 | 2.4 | 2.4 | 2.4 |
| | Radius cumulation (%) | 93.0 | 93.0 | 93.0 | 93.0 | 93.0 | 93.0 | 93.0 |
| Fifth envelope layer | Material No. | k | k | k | k | k | k | k |
| | Hardness (Shore D) | 65 | 65 | 65 | 65 | 65 | 65 | 65 |
| | Tensile elastic modulus (MPa) | 226.2 | 226.2 | 226.2 | 226.2 | 226.2 | 226.2 | 226.2 |
| | Thickness (mm) | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 |
| Cover | Material No. | l | l | l | l | l | l | l |
| | Hardness Hc (Shore D) | 32 | 32 | 32 | 32 | 32 | 32 | 32 |
| | Thickness (mm) | 0.5 | 0.5 | 0.5 | 0.5 | 0.5 | 0.5 | 0.5 |
| Hardness difference (Ho − Hs) | | 8 | 8 | 16 | 26 | 8 | 2 | 10 |
| Hardness difference (Hh − Hs) | | 38 | 38 | 46 | 46 | 38 | 38 | 46 |
| Hardness difference (Hh − Ho) | | 30 | 30 | 30 | 20 | 30 | 36 | 36 |
| Physical properties | Compression deformation amount (mm) | 2.71 | 2.80 | 2.73 | 2.71 | 2.81 | 2.76 | 2.79 |
| | Driver spin rate Sd (rpm) | 2382 | 2378 | 2326 | 2400 | 2322 | 2488 | 2446 |
| | Approach spin rate Sa10 (rpm) | 3797 | 3746 | 3799 | 3801 | 3749 | 3737 | 3748 |
| | Sd/Sa10 | 0.63 | 0.63 | 0.61 | 0.63 | 0.62 | 0.67 | 0.65 |

TABLE 8

| | Golf ball No. | 3-8 | 3-9 | 3-10 | 3-11 |
|---|---|---|---|---|---|
| Center | Material No. | f | g | a | f |
| | Hardness Ho1 (Shore D) | 29 | 25 | 45 | 29 |
| | Hardness Ho2 (Shore D) | 29 | 25 | 45 | 29 |
| | Tensile elastic modulus (MPa) | 19.5 | 15.1 | 58.8 | 19.5 |
| | Diameter (mm) | 20 | 15 | 15 | 15 |
| | Radius cumulation (%) | 46.7 | 35.0 | 35.0 | 35.0 |
| First envelope layer | Material No. | a | a | g | g |
| | Hardness (Shore D) | 45 | 45 | 25 | 25 |
| | Tensile elastic modulus (MPa) | 58.8 | 58.8 | 15.1 | 15.1 |
| | Thickness (mm) | 5.0 | 2.5 | 2.5 | 2.5 |
| | Radius cumulation (%) | 70.1 | 46.7 | 46.7 | 46.7 |
| Second envelope layer | Material No. | C | E | E | E |
| | Hardness (Shore D) | 27 | 45 | 45 | 45 |
| | Tensile elastic modulus (MPa) | 9.2 | 42.5 | 42.5 | 42.5 |
| | Thickness (mm) | 2.5 | 7.5 | 7.5 | 7.5 |
| | Radius cumulation (%) | 81.8 | 81.8 | 81.8 | 81.8 |
| Third envelope layer | Material No. | — | — | — | — |
| | Hardness (Shore D) | — | — | — | — |
| | Tensile elastic modulus (MPa) | — | — | — | — |
| | Thickness (mm) | — | — | — | — |
| | Radius cumulation (%) | — | — | — | — |
| Fourth envelope layer | Material No. | b | b | b | g |
| | Hardness (Shore D) | 54 | 54 | 54 | 25 |
| | Tensile elastic modulus (MPa) | 114.1 | 114.1 | 114.1 | 15.1 |
| | Thickness (mm) | 2.4 | 2.4 | 2.4 | 2.4 |
| | Radius cumulation (%) | 93.0 | 93.0 | 93.0 | 93.0 |
| Fifth envelope layer | Material No. | k | k | k | k |
| | Hardness (Shore D) | 65 | 65 | 65 | 65 |
| | Tensile elastic modulus (MPa) | 226.2 | 226.2 | 226.2 | 226.2 |
| | Thickness (mm) | 1.0 | 1.0 | 1.0 | 1.0 |
| | Radius cumulation (%) | 97.7 | 97.7 | 97.7 | 97.7 |

TABLE 8-continued

| | Golf ball No. | 3-8 | 3-9 | 3-10 | 3-11 |
|---|---|---|---|---|---|
| Cover | Material No. | l | l | l | l |
| | Hardness Hc (Shore D) | 32 | 32 | 32 | 32 |
| | Thickness (mm) | 0.5 | 0.5 | 0.5 | 0.5 |
| Hardness difference (Ho − Hs) | | 2 | — | 20 | 4 |
| Hardness difference (Hh − Hs) | | 38 | 40 | 40 | 40 |
| Hardness difference (Hh − Ho) | | 36 | 40 | 20 | 36 |
| Physical properties | Compression deformation amount (mm) | 3.04 | 2.76 | 2.78 | 2.81 |
| | Driver spin rate Sd (rpm) | 2566 | 2653 | 2614 | 2479 |
| | Approach spin rate Sa10 (rpm) | 3590 | 3595 | 3606 | 3558 |
| | Sd/Sa10 | 0.71 | 0.74 | 0.73 | 0.70 |

TABLE 9

| | Golf ball No. | 4-1 | 4-2 | 4-3 | 4-4 | 4-5 | 4-6 | 4-7 | 4-8 |
|---|---|---|---|---|---|---|---|---|---|
| Center | Material No. | A | A | A | A | A | A | A | A |
| | Hardness Ho1 (Shore D) | 34 | 34 | 34 | 34 | 34 | 34 | 34 | 34 |
| | Hardness Ho2 (Shore D) | 34 | 34 | 34 | 34 | 34 | 34 | 34 | 34 |
| | Tensile elastic modulus (MPa) | 16.3 | 16.3 | 16.3 | 16.3 | 16.3 | 16.3 | 16.3 | 16.3 |
| | Diameter (mm) | 15 | 15 | 15 | 15 | 15 | 15 | 20 | 15 |
| | Radius cumulation (%) | 35.0 | 35.0 | 35.0 | 35.0 | 35.0 | 35.0 | 46.7 | 35.0 |
| First envelope layer | Material No. | f | f | g | f | g | a | a | a |
| | Hardness (Shore D) | 29 | 29 | 25 | 29 | 25 | 45 | 45 | 45 |
| | Tensile elastic modulus (MPa) | 19.5 | 19.5 | 15.1 | 19.5 | 15.1 | 58.8 | 58.8 | 58.8 |
| | Thickness (mm) | 2.5 | 2.5 | 2.5 | 2.5 | 2.5 | 2.5 | 2.5 | 2.5 |
| | Radius cumulation (%) | 46.7 | 46.7 | 46.7 | 46.7 | 46.7 | 46.7 | 58.4 | 46.7 |
| Second envelope layer | Material No. | h | h | h | h | h | g | d | h |
| | Hardness (Shore D) | 15 | 15 | 15 | 15 | 15 | 25 | 23 | 15 |
| | Tensile elastic modulus (MPa) | 7.4 | 7.4 | 7.4 | 7.4 | 7.4 | 15.1 | 13.0 | 7.4 |
| | Thickness (mm) | 2.5 | 2.5 | 2.5 | 2.5 | 2.5 | 2.5 | 2.5 | 2.5 |
| | Radius cumulation (%) | 58.4 | 58.4 | 58.4 | 58.4 | 58.4 | 58.4 | 70.1 | 58.4 |
| Third envelope layer | Material No. | a | a | a | a | a | a | a | a |
| | Hardness (Shore D) | 45 | 45 | 45 | 45 | 45 | 45 | 45 | 45 |
| | Tensile elastic modulus (MPa) | 58.8 | 58.8 | 58.8 | 58.8 | 58.8 | 58.8 | 58.8 | 58.8 |
| | Thickness (mm) | 2.5 | 5.0 | 2.5 | 2.5 | 5.0 | 5.0 | 2.5 | 5.0 |
| | Radius cumulation (%) | 70.1 | 81.8 | 70.1 | 70.1 | 81.8 | 81.8 | 81.8 | 81.8 |
| Fourth envelope layer | Material No. | b | b | b | b | b | b | b | b |
| | Hardness (Shore D) | 54 | 54 | 54 | 54 | 54 | 54 | 54 | 54 |
| | Tensile elastic modulus (MPa) | 114.1 | 114.1 | 114.1 | 114.1 | 114.1 | 114.1 | 114.1 | 114.1 |
| | Thickness (mm) | 4.9 | 2.4 | 4.9 | 4.9 | 2.4 | 2.4 | 2.4 | 2.4 |
| | Radius cumulation (%) | 93.0 | 93.0 | 93.0 | 93.0 | 93.0 | 93.0 | 93.0 | 93.0 |
| Fifth envelope layer | Material No. | k | k | k | k | k | k | k | k |
| | Hardness (Shore D) | 65 | 65 | 65 | 65 | 65 | 65 | 65 | 65 |
| | Tensile elastic modulus (MPa) | 226.2 | 226.2 | 226.2 | 226.2 | 226.2 | 226.2 | 226.2 | 226.2 |
| | Thickness (mm) | 1.0 | 1.0 | 1.0 | 1.0 | 1.0 | 1.0 | 1.0 | 1.0 |
| | Radius cumulation (%) | 97.7 | 97.7 | 97.7 | 97.7 | 97.7 | 97.7 | 97.7 | 97.7 |
| Cover | Material No. | l | l | l | l | l | l | l | l |
| | Hardness Hc (Shore D) | 32 | 32 | 32 | 32 | 32 | 32 | 32 | 32 |
| | Thickness (mm) | 0.5 | 0.5 | 0.5 | 0.5 | 0.5 | 0.5 | 0.5 | 0.5 |
| Hardness difference (Ho − Hs) | | 19 | 19 | 19 | 19 | 19 | 9 | 11 | 19 |
| Hardness difference (Hh − Hs) | | 50 | 50 | 50 | 50 | 50 | 40 | 43 | 50 |
| Hardness difference (Hh − Ho) | | 31 | 31 | 31 | 31 | 31 | 31 | 31 | 31 |
| Physical properties | Compression deformation amount (mm) | 2.72 | 2.80 | 2.73 | 2.70 | 2.82 | 2.69 | 2.83 | 2.76 |
| | Driver spin rate Sd (rpm) | 2367 | 2363 | 2311 | 2400 | 2308 | 2639 | 2557 | 2534 |
| | Approach spin rate Sa10 (rpm) | 3799 | 3749 | 3802 | 3749 | 3751 | 3713 | 3510 | 3741 |
| | Sd/Sa10 | 0.62 | 0.63 | 0.61 | 0.65 | 0.62 | 0.71 | 0.73 | 0.68 |

TABLE 10

| | Golf ball No. | 4-9 | 4-10 | 4-11 | 4-12 | 4-13 | 5-1 |
|---|---|---|---|---|---|---|---|
| Center | Material No. | A | A | A | A | A | A |
| | Hardness Ho1 (Shore D) | 34 | 34 | 34 | 34 | 34 | 34 |
| | Hardness Ho2 (Shore D) | 34 | 34 | 34 | 34 | 34 | 34 |
| | Tensile elastic modulus (MPa) | 16.3 | 16.3 | 16.3 | 16.3 | 16.3 | 16.3 |
| | Diameter (mm) | 20 | 20 | 15 | 15 | 15 | 15 |
| | Radius cumulation (%) | 46.7 | 46.7 | 35.0 | 35.0 | 35.0 | 35.0 |
| First envelope layer | Material No. | a | a | a | g | g | B |
| | Hardness (Shore D) | 45 | 45 | 45 | 25 | 25 | 51 |
| | Tensile elastic modulus (MPa) | 58.8 | 58.8 | 58.8 | 15.1 | 15.1 | 126.2 |
| | Thickness (mm) | 2.5 | 5.0 | 2.5 | 2.5 | 2.5 | 12.4 |
| | Radius cumulation (%) | 58.4 | 70.1 | 46.7 | 46.7 | 46.7 | 93.0 |
| Second envelope layer | Material No. | h | g | a | a | a | k |
| | Hardness (Shore D) | 15 | 25 | 45 | 45 | 45 | 65 |
| | Tensile elastic modulus (MPa) | 7.4 | 15.1 | 58.8 | 58.8 | 58.8 | 226.2 |
| | Thickness (mm) | 2.5 | 2.5 | 7.5 | 7.5 | 7.5 | 1.0 |
| | Radius cumulation (%) | 70.1 | 81.8 | 81.8 | 81.8 | 81.8 | 97.7 |
| Third envelope layer | Material No. | a | — | — | — | — | — |
| | Hardness (Shore D) | 45 | — | — | — | — | — |
| | Tensile elastic modulus (MPa) | 58.8 | — | — | — | — | — |
| | Thickness (mm) | 2.5 | — | — | — | — | — |
| | Radius cumulation (%) | 81.8 | — | — | — | — | — |
| Fourth envelope layer | Material No. | b | b | b | b | g | — |
| | Hardness (Shore D) | 54 | 54 | 54 | 54 | 25 | — |
| | Tensile elastic modulus (MPa) | 114.1 | 114.1 | 114.1 | 114.1 | 15.1 | — |
| | Thickness (mm) | 2.4 | 2.4 | 2.4 | 2.4 | 2.4 | — |
| | Radius cumulation (%) | 93.0 | 93.0 | 93.0 | 93.0 | 93.0 | — |
| Fifth envelope layer | Material No. | k | k | k | k | k | — |
| | Hardness (Shore D) | 65 | 65 | 65 | 65 | 65 | — |
| | Tensile elastic modulus (MPa) | 226.2 | 226.2 | 226.2 | 226.2 | 226.2 | — |
| | Thickness (mm) | 1.0 | 1.0 | 1.0 | 1.0 | 1.0 | — |
| | Radius cumulation (%) | 97.7 | 97.7 | 97.7 | 97.7 | 97.7 | — |
| Cover | Material No. | l | l | l | l | l | l |
| | Hardness Hc (Shore D) | 32 | 32 | 32 | 32 | 32 | 32 |
| | Thickness (mm) | 0.5 | 0.5 | 0.5 | 0.5 | 0.5 | 0.5 |
| Hardness difference (Ho − Hs) | | 19 | 9 | — | 9 | 9 | — |
| Hardness difference (Hh − Hs) | | 50 | 40 | 31 | 40 | 40 | — |
| Hardness difference (Hh − Hs) | | 31 | 31 | 31 | 31 | 31 | 31 |
| Physical properties | Compression deformation amount (mm) | 2.90 | 2.87 | 2.59 | 2.64 | 2.87 | 2.60 |
| | Driver spin rate Sd (rpm) | 2511 | 2701 | 2812 | 2630 | 2859 | 2300 |
| | Approach spin rate Sa10 (rpm) | 3462 | 3520 | 3668 | 3676 | 3631 | 3350 |
| | Sd/Sa10 | 0.73 | 0.77 | 0.77 | 0.72 | 0.79 | 0.69 |

This application is based on Japanese Patent Application No. 2014-135404 filed on Jun. 30, 2014, No. 2014-135409 filed on Jun. 30, 2014, No. 2015-099147 filed on May 14, 2015 and No. 2015-099151 filed on May 14, 2015, the contents of which are hereby incorporated by reference.

The invention claimed is:

1. A golf ball comprising a spherical center, at least four envelope layers covering the spherical center, and a cover covering the envelope layers, wherein an envelope layer (Es1), which is formed from a material having a material hardness (Hs1) that is lowest among the center and other envelope layers, is disposed in a region located at a radial distance of from 36.0% to 65.0% of the golf ball radius from the golf ball center point, an envelope layer (Eh1), which is formed from a material having a material hardness (Hh1) that is highest among the center, cover and other envelope layers, is disposed in a region located at a radial distance of from 85.0% to 99.5% of the golf ball radius from the golf ball center point, an envelope layer (E11) is disposed between the spherical center and the envelope layer (Es1), and a material hardness (H11) of the envelope layer (E11) is higher than the material hardness (Hs1) of the envelope layer (Es1) and smaller than a material hardness (Ho1) of the spherical center.

2. The golf ball according to claim 1, wherein the envelope layer (Es1) is disposed in a region located at a radial distance of from 40.0% to 62.5% of the golf ball radius from the golf ball center point.

3. The golf ball according to claim 1, wherein a hardness difference (Hh1−Hs1) between the material hardness (Hs1) of the envelope layer (Es1) and the material hardness (Hh1) of the envelope layer (Eh1) is 30 or more in Shore D hardness.

4. The golf ball according to claim 1, wherein a hardness difference (Ho1−Hs1) between the material hardness (Hs1) of the envelope layer (Es1) and the material hardness (Ho1) of the spherical center is 1 or more in Shore D hardness.

5. The golf ball according to claim 1, wherein the envelope layer (Es1) has the material hardness (Hs1) of 30 or less in Shore D hardness.

6. The golf ball according to claim 1, wherein a hardness difference (Hh1−Ho1) between the material hardness (Hh1) of the envelope layer (Eh1) and the material hardness (Ho1) of the spherical center is 1 or more in Shore D hardness.

7. The golf ball according to claim 1, wherein the envelope layer (Eh1) has the material hardness (Hh1) of 30 or more in Shore D hardness.

8. The golf ball according to claim 3, wherein a hardness difference (Ho1−Hs1) between the material hardness (Hs1) of the envelope layer (Es1) and the material hardness (Ho1) of the spherical center is 1 or more in Shore D hardness, and a hardness difference (Hh1−Ho1) between the material hardness (Hh1) of the envelope layer (Eh1) and the material hardness (Ho1) of the spherical center is 1 or more in Shore D hardness.

9. The golf ball according to claim 8, wherein the envelope layer (Es1) has the material hardness (Hs1) of 30 or less in Shore D hardness, and the envelope layer (Eh1) has the material hardness (Hh1) of 30 or more in Shore D hardness.

10. The golf ball according to claim 1, wherein the spherical center has the material hardness (Ho1) in a range from 15 to 55 in Shore D hardness.

11. The golf ball according to claim 1, wherein the golf ball has a diameter ranging from 40 mm to 45 mm, the diameter of the spherical center is 20 mm or less, the thickness of the envelope layer (Eh1) is 3 mm or less, and the thickness of the cover is 1.0 mm or less.

12. The golf ball according to claim 1, wherein the hardness (Shore D hardness) ratio (Hh1/Hs1) between the material hardness (Hs1) of the envelope layer (Es1) and the material hardness (Hh1) of the envelope layer (Eh1) ranges from 1.1 to 35.

13. The golf ball according to claim 1, wherein the hardness (Shore D hardness) ratio (Ho1/Hs1) between the material hardness (Hs1) of the envelope layer (Es1) and the material hardness (Ho1) of the center ranges from 1.05 to 20.

14. The golf ball according to claim 1, wherein the hardness (Shore D hardness) ratio (Hh1/Ho1) between the material hardness (Hh1) of the envelope layer (Eh1) and the material hardness (Ho1) of the center ranges from 1.0 to 2.4.

15. The golf ball according to claim 1, wherein the spherical center has a diameter in a range from 5 mm to 25 mm, and the compression deformation amount (deformation amount of the center along the compression direction) of the spherical center when applying a load from 98 N as an initial load to 1275 N as a final load to the spherical center ranges from 1.5 mm to 5.0 mm.

16. The golf ball according to claim 1, wherein the thickness of the envelope layer other than the envelope layer (Es1) and the envelope layer (Eh1) ranges from 0.1 mm to 15 mm.

17. The golf ball according to claim 1, wherein a material hardness (Hc1) of the cover ranges from 5 to 55 in Shore D hardness.

18. The golf ball according to claim 1, wherein the golf ball has a diameter in a range from 40 mm to 45 mm, and the compression deformation amount (deformation amount along the compression direction) of the golf ball when applying a load from 98 N as an initial load to 1275 N as a final load to the golf ball ranges from 2.0 mm to 4.0 mm.

* * * * *